US008047100B2

(12) United States Patent
King

(10) Patent No.: US 8,047,100 B2
(45) Date of Patent: Nov. 1, 2011

(54) TOOL ASSEMBLY HAVING TELESCOPING FASTENER SUPPORT

(75) Inventor: Wade C. King, Finksburg, MD (US)

(73) Assignee: Black & Decker Inc., Newark, DE (US)

( * ) Notice: Subject to any disclaimer, the term of this patent is extended or adjusted under 35 U.S.C. 154(b) by 357 days.

(21) Appl. No.: 12/362,173

(22) Filed: Jan. 29, 2009

(65) Prior Publication Data

US 2009/0206122 A1 Aug. 20, 2009

Related U.S. Application Data

(60) Provisional application No. 61/029,162, filed on Feb. 15, 2008.

(51) Int. Cl.
*B25B 23/08* (2006.01)

(52) U.S. Cl. ..... 81/57.37; 81/451

(58) Field of Classification Search ..... 81/57.37, 81/431, 433, 451, 456–458; 227/139
See application file for complete search history.

(56) References Cited

U.S. PATENT DOCUMENTS

| | | | | |
|---|---|---|---|---|
| 989,758 | A * | 4/1911 | Bowers | 81/456 |
| 2,884,971 | A | 5/1959 | Dierker | |
| 3,323,394 | A | 6/1967 | Bangerter et al. | |
| 3,707,894 | A | 1/1973 | Stillwagon, Jr. | |
| 3,730,237 | A | 5/1973 | Hanzlik | |
| 3,740,999 | A | 6/1973 | Whitehouse | |
| 3,776,443 | A | 12/1973 | Oefinger | |
| 4,404,877 | A | 9/1983 | Mizuno et al. | |
| 4,488,604 | A | 12/1984 | Whitehouse | |
| 4,523,115 | A | 6/1985 | Cuneo | |
| 4,653,358 | A | 3/1987 | Lankry | |
| 4,655,380 | A | 4/1987 | Haytayan | |
| 4,744,273 | A * | 5/1988 | Bartok, Jr. | 81/453 |
| 5,089,729 | A | 2/1992 | Moores, Jr. | |
| 5,207,127 | A | 5/1993 | Nick | |
| 5,309,799 | A | 5/1994 | Jore | |
| 5,341,708 | A | 8/1994 | Nick | |
| 5,671,642 | A | 9/1997 | Haas | |
| 6,301,997 | B1 | 10/2001 | Welte | |
| 6,502,648 | B2 | 1/2003 | Milbourne | |
| 6,668,941 | B2 | 12/2003 | Phillips et al. | |
| 7,223,195 | B2 | 5/2007 | Milbourne et al. | |
| 2006/0193705 | A1 | 8/2006 | Campbell | |

(Continued)

FOREIGN PATENT DOCUMENTS

| | | |
|---|---|---|
| DE | 3104460 | 6/1982 |

(Continued)

*Primary Examiner* — Debra S Meislin
(74) *Attorney, Agent, or Firm* — Harness, Dickey & Pierce, P.L.C.

(57) ABSTRACT

A tool assembly with a driving tool and a holder assembly. The driving tool has a housing, a motor, an output member and a transmission for rotatably coupling the output member to the motor. The motor and the transmission are housed in the housing. The holder assembly has a leg, which is telescopically coupled to the housing, a fastener guide and an adjustment mechanism. The fastener guide includes a longitudinally extending groove that is configured to support a threaded fastener and a cam that is disposed transverse to the groove. The adjustment mechanism couples the fastener guide to the leg on a side of the leg opposite the housing. The adjustment mechanism is configured to vary a distance between the groove and a rotational axis of the output member.

15 Claims, 18 Drawing Sheets

U.S. PATENT DOCUMENTS

2007/0079672 A1 4/2007 Bone et al.

FOREIGN PATENT DOCUMENTS

DE 4141961 6/1993
DE 10343642 4/2005
FR 2781402 1/2000
WO WO-2004106007 12/2004

* cited by examiner

TOOL ASSEMBLY HAVING TELESCOPING FASTENER SUPPORT

CROSS-REFERENCE TO RELATED APPLICATIONS

This application claims the benefit of U.S. Provisional Patent Application Ser. No. 61/029,162 filed Feb. 15, 2008, the disclosure of which is hereby incorporated by reference as if fully set forth in its entirety herein.

INTRODUCTION

The present invention generally relates to tool assembly and more particularly to a tool assembly having a means for supporting a threaded fastener before the threaded fastener is driven into a workpiece.

When hanging objects on a wall, such as brackets, it is often times cumbersome to substantially simultaneously hold the object in a desired location, position a threaded fastener in a hole in the object, engage the head of the threaded fastener with a tool bit that is coupled to a driving tool and operate the driving tool to drive the threaded fastener into the wall.

U.S. Pat. No. 5,671,642 discloses a drill-mounted tool for centering and supporting a threaded fastener before the threaded fastener is engaged to a workpiece. The device includes a plurality of jaws that require adjustment to the threaded fastener. Moreover, the device is relatively big and bulky, so as to increase the overall length of the drill.

Accordingly, there remains a need in the art for a tool assembly with a driving tool and a relatively small, compact and lightweight means for selectively supporting a threaded fastener before the threaded fastener is driven into a workpiece.

SUMMARY

In one form, the present teachings provide a tool assembly with a driving tool and a holder assembly. The driving tool has a housing, a motor, an output member and a transmission for rotatably coupling the output member to the motor. The motor and the transmission are housed in the housing. The holder assembly has a leg, which is telescopically coupled to the housing, a fastener guide and an adjustment mechanism. The fastener guide includes a longitudinally extending groove that is configured to support a threaded fastener and a cam that is disposed transverse to the groove. The adjustment mechanism couples the fastener guide to the leg on a side of the leg opposite the housing. The adjustment mechanism is configured to vary a distance between the groove and a rotational axis of the output member.

Further areas of applicability will become apparent from the description provided herein. It should be understood that the description and specific examples are intended for purposes of illustration only and are not intended to limit the scope of the present disclosure.

BRIEF DESCRIPTION OF THE DRAWINGS

The drawings described herein are for illustration purposes only and are not intended to limit the scope of the present disclosure in any way.

FIGS. 10 through 23 illustrate portions of another tool assembly constructed in accordance with the teachings of the present disclosure, wherein:

FIG. 10 is an exploded perspective view of a portion of the tool assembly illustrating the nose of the housing and the holder assembly;

FIG. 11 is a bottom view of the portion of the tool assembly illustrated in FIG. 10;

FIG. 12 is an exploded perspective view of a clutch ring exploded from the nose of the housing;

FIG. 13 is a perspective view of the clutch ring coupled to the nose of the housing;

FIG. 14 is a perspective view of a spring exploded from the spring arms of the leg of the holder assembly;

FIG. 15 is a perspective view of the spring arms of the holder assembly engaged to a detent track formed in the housing of the tool assembly;

FIG. 16 is a bottom plan view of the stops of the leg in contact with a ledge in the nose of the housing;

FIG. 17 is a perspective view of a sub-assembly that includes a portion of the housing, a motor, a transmission, a clutch and an output member;

FIG. 18 is an exploded perspective view illustrating a switching assembly exploded from the subassembly illustrated in FIG. 17;

FIG. 19 is a perspective view illustrating the switching assembly coupled to the subassembly illustrated in FIG. 17;

FIG. 20 is an exploded perspective view illustrating the assembly of the subassembly illustrated in FIG. 17 with the nose of the housing;

FIG. 21 is an exploded perspective view of a portion of the tool assembly illustrating the coupling of a portion of the clutch to the clutch ring;

FIG. 22 is an exploded perspective view of a portion of the tool assembly illustrating the coupling of a spring of the switching assembly to the clutch ring;

FIG. 23 is a perspective view illustrating a portion of the tool assembly;

FIGS. 24 through 27 illustrate portions of another tool assembly constructed in accordance with the teachings of the present disclosure, wherein:

FIG. 24 is an exploded perspective view of a portion of the tool assembly illustrating a portion of its fastener guide and adjustment mechanism;

FIG. 25 is a longitudinal cross section view of the portion of the tool assembly illustrated in FIG. 24;

FIG. 26 is an exploded perspective view illustrating a more complete portion of its fastener guide and adjustment mechanism;

FIG. 27 is a perspective, partly sectioned view of the fastener guide;

DETAILED DESCRIPTION OF THE VARIOUS EMBODIMENTS

Figure 1:
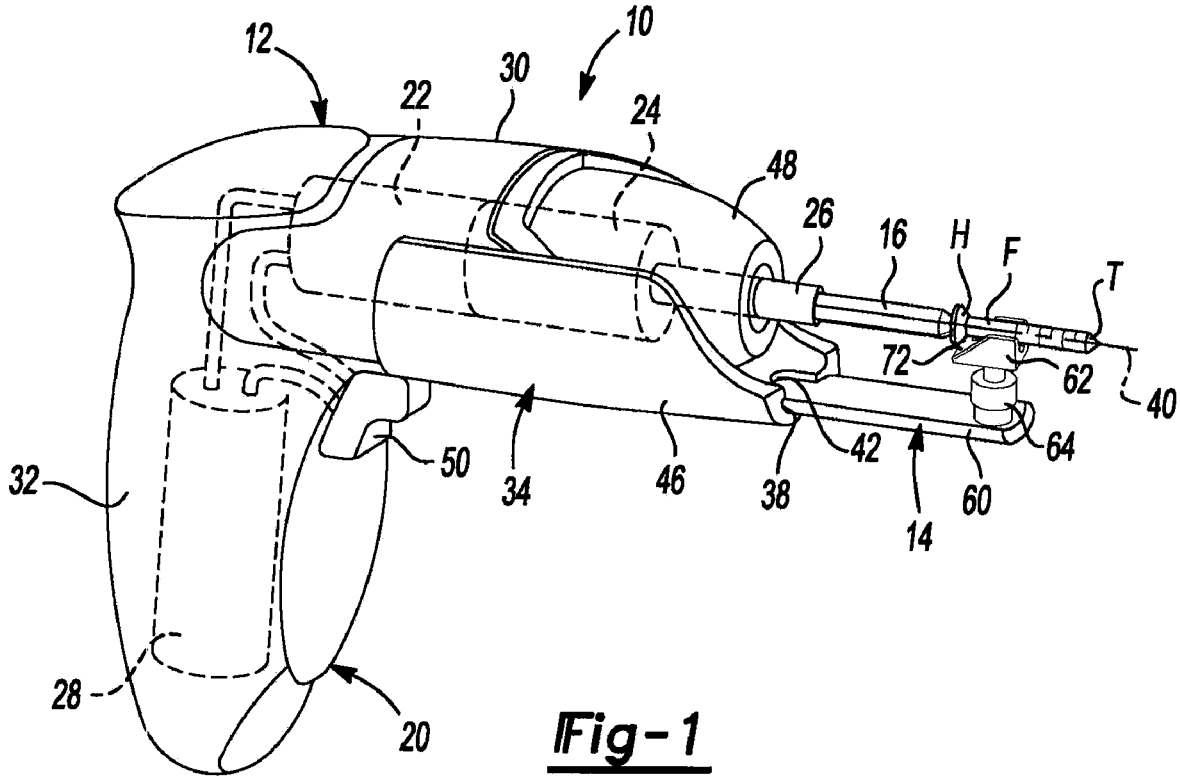
FIG. 1 is a perspective view of an exemplary tool assembly constructed in accordance with the teachings of the present disclosure, the exemplary tool assembly including a holder assembly that is shown in an extended position.

With reference to FIG. 1 of the drawings, a tool assembly constructed in accordance with the teachings of the present invention is generally indicated by reference numeral 10. The tool assembly 10 can include a driving tool 12, a holder assembly 14, and a tool bit 16. The driving tool 12 can be any type of tool that is configured to provide a rotary output, such as a nutrunner, a screwdriver, a drill/driver or a hammer-drill/driver, and can be powered by any desired means, including electrically, pneumatically and/or hydraulically. In the particular example provided, the driving tool 12 is a battery-powered screwdriver that includes a generally L-shaped housing 20, an electric motor 22, a transmission 24, an output member 26 and a battery 28.

Figure 2:
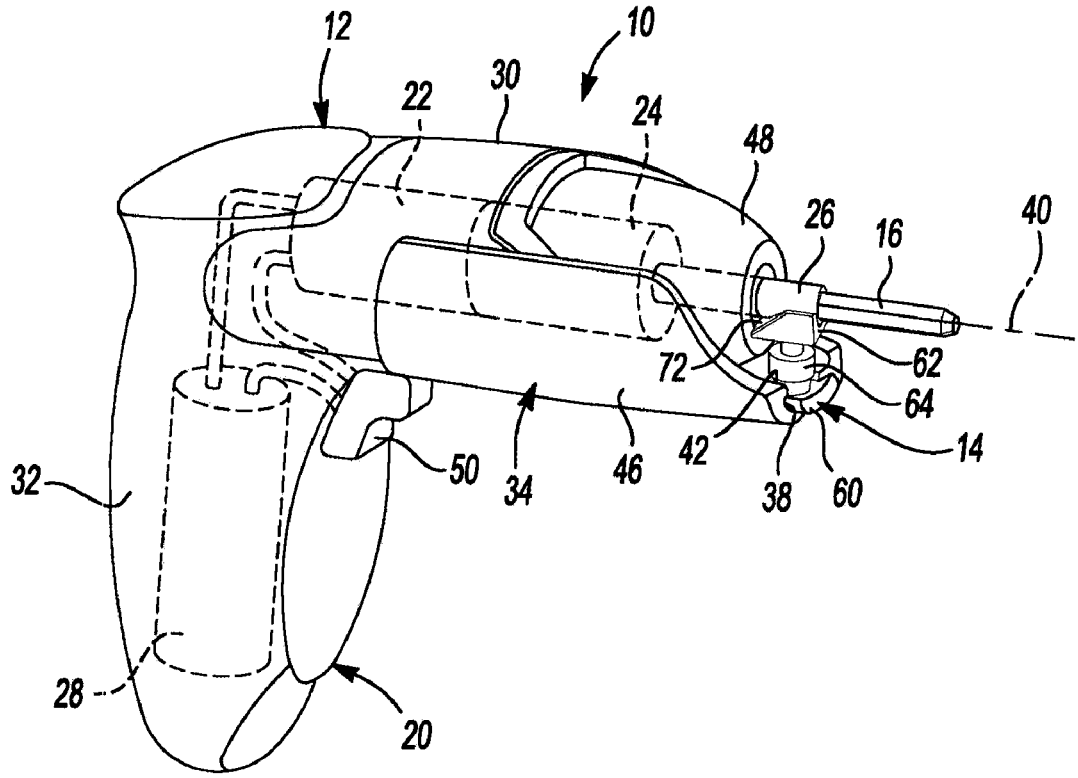
FIG. 2 is a perspective view similar to that of FIG. 1, but illustrating the holder assembly in a retracted position.
Figure 3:
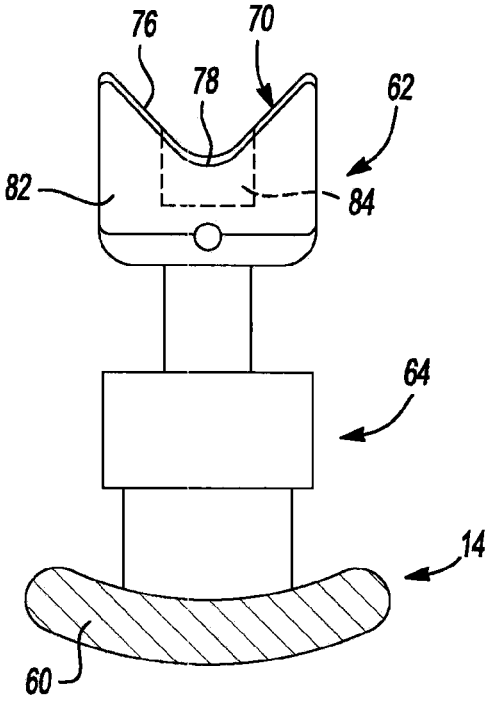
FIG. 3 is an end view of a portion of the exemplary tool assembly of FIG. 1, showing a portion of the holder assembly in more detail.
Figure 4:
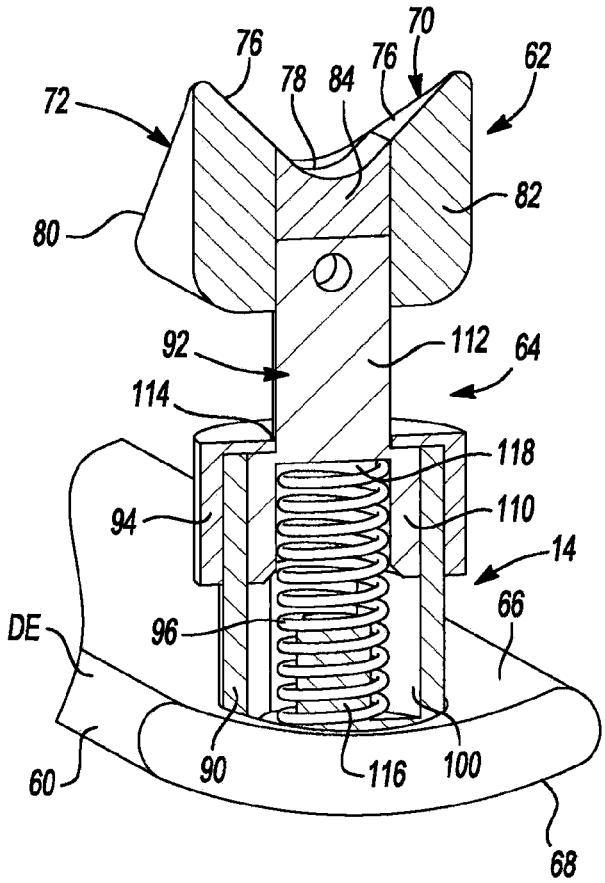
FIG. 4 is a longitudinal section view of a portion of the holder assembly that illustrates the construction of an exemplary adjustment mechanism.

The housing 20 can define a body 30, a handle 32 and a mount 34. The body 30 can have a cavity (not specifically shown) into which the motor 22 and transmission 24 can be received, while the handle 32 can have a cavity (not specifically shown) into which the battery 28 can be received. The mount 34 can be coupled to or integrally formed with the body 30 on a side opposite the handle 32 and define a longitudinally extending slot 38, which can extend generally parallel to the rotational axis 40 of the output member 26, and a recess 42 that can be located below the output member 26 in a vertical plane that extends through the rotational axis 40 of the output member 26. In the example provided, the mount 34 includes an arcuate wall member 46 that can extend forwardly of a nose 48 of the body 30 (but axially rearward of the end of the output member 26) to shield or guard the holder assembly 14 when the holder assembly 14 is in a retracted position as shown in FIG. 2.

A conventional trigger switch 50 can be electrically coupled to the battery 28 and the motor 22 and can be housed in the housing 20. The trigger switch 50 can be employed to selectively distribute electrical energy form the battery 28 to the motor 22. The transmission 24 can be any type of transmission that can couple the output member 26 to the motor 22, but in the example provided the transmission 24 is a one-speed, three-stage planetary-type transmission that receives an input from the motor 22 and provides a rotary output to the output member 26. While not shown, the driving tool 12 can include a torque clutch for limiting the magnitude of the torque that is transmitted between the motor 22 and the output member 26. The output member 26 can be configured in a conventional manner to releasably receive the tool bit 16. The tool bit 16 can be any commercially available tool bit for driving a threaded fastener.

With reference to FIGS. 2 through 5, the holder assembly 14 can include a leg 60, a fastener guide 62 and an adjustment mechanism 64 for adjusting a height of the fastener guide 62 relative to the leg 60. The leg 60 can be slidably received into the longitudinally extending slot 38 in the mount 34 so as to be telescopically coupled to the housing 20. A stop member S (FIG. 9) can be coupled to a proximal end PE (FIG. 9) of the leg 60; the stop member S (FIG. 9) can contact the housing 20 to prevent the leg 60 from being withdrawn from the housing 20 when the holder assembly 14 is positioned in an extended position (FIG. 1). In the particular example provided, the leg 60 has an arcuate shape when viewed in lateral cross-section that positions the upper and lower surfaces 66 and 68, respectively, of the leg 60 concentrically about the transmission 24, as well as increases the stiffness of the leg 60 so that the leg 60 is relatively stronger and easily packaged into the driving tool 12. While the leg 60 is illustrated as being unitarily formed, it will be appreciated that the leg 60 could be formed from two or more interconnected segments that can be telescopically coupled to one another.

Figure 5:
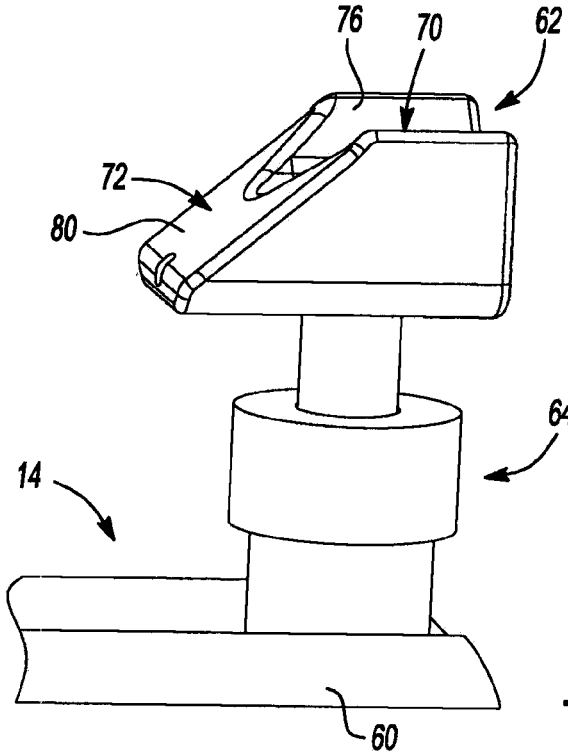
FIG. 5 is a perspective view of a portion of the holder assembly, illustrating the fastener guide and the adjustment mechanism in more detail.
Figure 7:
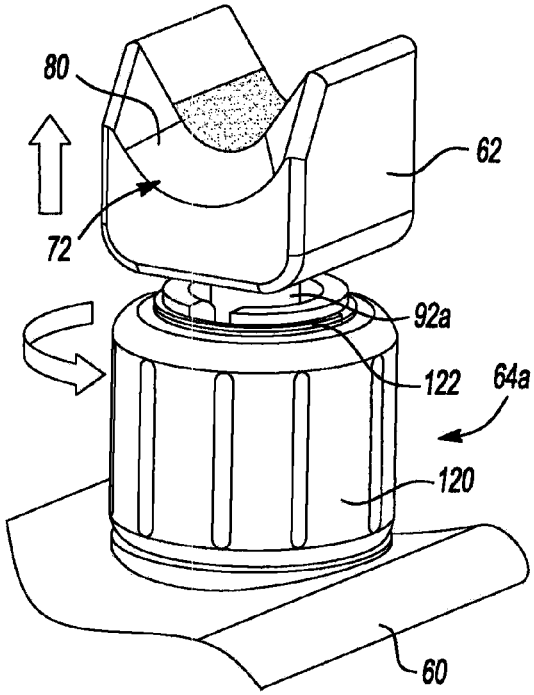
FIG. 7 is a perspective view of another exemplary adjustment mechanism for adjusting a position of the fastener guide.

The fastener guide 62 can include a longitudinally extending groove 70 and a cam 72. The groove 70 can be a generally V-shaped groove having a pair of transverse wall members 76 that are configured to support a threaded fastener F (FIG. 1) that is received into the groove 70. The groove 70 can be contoured in any desired manner, but in the example provided a radius 78 corresponding to the radius of a number 10 threaded fastener is employed at the intersection of the transverse wall members 76. The cam 72 can be formed on a rear side of the fastener guide 62 and can include a sloped surface 80 that tapers rearwardly (toward the body 30 of the housing 20) and downwardly (away from the rotational axis 40 of the output member 26). The sloped surface 80 can be configured as a flat planar surface as shown in FIG. 5, or could be a frustoconical surface as shown in FIG. 7. At least a portion of the fastener guide 62 can be magnetic to magnetically attract and seat ferrous fasteners in the groove 70. In the embodiment illustrated, the fastener guide 62 includes a base 82 and a discrete magnet 84 that is coupled to the base 82. The discrete magnet 84 can partially define the transverse wall members 76 and/or the radius 78 and can be formed of a material having strong magnetic properties, such as nickel-iron-boron or samarium-cobalt.

The adjustment mechanism 64 couples the fastener guide 62 to the leg 60 on a side opposite the housing 20. The adjustment mechanism 64 can be configured to selectively position the fastener guide 62 in a vertical direction between the rotational axis 40 of the output member 26 and the leg 60. Stated another way, the adjustment mechanism 64 is configured to vary a distance between the groove 70 and the rotational axis 40. The adjustment mechanism 64 can include a cylinder 90, a piston 92, a cap 94, and a spring 96. The cylinder 90 can be a hollow tubular structure that can define an interior chamber 100 having a non-circular lateral cross-sectional shape (e.g., a hexagonal shape). The cylinder 90 can be coupled to a distal end DE of the leg 60. The piston 92 can include a first portion 110 and a second portion 112. The first portion 110 can be received into the interior chamber 100 and can be sized to slidably but non-rotatably engage the cylinder 90 (e.g., the first portion 110 can have a hexagonal shape that corresponds to the hexagonal shape of the interior chamber 100). The second portion 112, which can be smaller in size than the first portion 110, can extend upwardly from the first portion 110 and be fixedly and non-rotatably coupled to the fastener guide 62 so as to orient the groove 70 parallel to the rotational axis 40 of the output member 26. The cap 94 can be coupled to the end of the cylinder 90 opposite the leg 60 and can include a circular aperture 114 through which the second portion 112 of the piston 92, which is cylindrical in the particular example illustrated, is received. The spring 96 can be received in the interior chamber 100 between the leg 60 and the first portion 110 of the piston 92 and can bias the piston 92 in a direction away from the leg 60. One or more spring guides can be employed to guide the spring 96. For example, a first spring guide 116, which can be cylindrically shaped, can extend from the leg 60 and received into the interior of the spring 96, while a second spring guide 118, which can be a cylindrical recess, can be formed into the first portion 110 of the piston 92 for receiving the spring 96. It will be appreciated that the piston 92 could be "keyed" to the leg 60 in various different ways and as such, the particular example disclosed should not be considered as limiting the scope of the present disclosure in any manner. For example, one of ordinary skill in the art would appreciate from this disclosure that the interior chamber 100 could be cylindrically shaped, the first portion 110 of the piston 92 could have a corresponding circular cross-section, that the second portion 112 of the piston 92 could have a non-circular lateral cross-sectional shape and that the aperture 114 in the cap 94 could be sized and oriented to align the piston 92 in a desired orientation relative to the leg 60.

Figure 6:
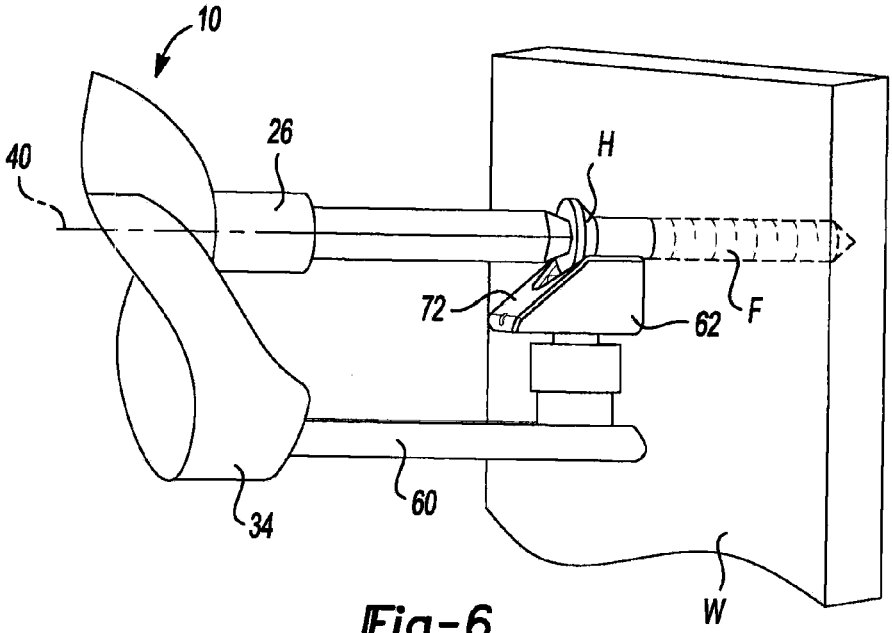
FIG. 6 is a perspective view of the exemplary tool assembly of FIG. 1, illustrating the head of a fastener cooperating with the cam on the fastener guide to drive the fastener guide in a direction away from the fastener.

With reference to FIG. 1, the operation of the tool assembly 10 will be described in detail. In operation, the leg 60 can be extended to a desired position to support a threaded fastener F while the head H of the threaded fastener F is engaged to the tool bit 16 and spaced apart from the cam 72. The user can activate the driving tool 12 (via the trigger switch 50 to initiate rotation of the tool bit 16) as the tip T of the threaded fastener F is urged into a workpiece W (FIG. 6). The holder assembly 14 can support the threaded fastener F as it is rotated and starts to thread into the workpiece W (FIG. 6). With reference to FIG. 6, contact between the holder assembly 14 (e.g., the leg 60) and the workpiece W as the threaded fastener F is driven into the workpiece will push the leg 60 into the mount 34 so that the fastener guide 62 travels rearwardly along the threaded fastener F. As the threaded fastener F is engaged to the tool bit 16 and threadably engaged to the workpiece, contact between the head H of the threaded fastener F and the cam 72 will cause the fastener guide 62 to travel vertically downward away from the rotational axis 40 of the output member 26 so that the head H of the threaded fastener F can be driven past the fastener guide 62 and into the workpiece W.

When the holder assembly 14 is positioned in the retracted position shown in FIG. 2, the adjustment mechanism 64 can be positioned in the recess 42 and the fastener guide 62 can be positioned in abutment with a desired surface on the driving tool 12 (e.g., the fastener guide 62 can be positioned proximate the housing 20 and disposed vertically in-line with the output member 26 such that the output member 26 is received into the groove 70 and abuts the transverse wall members 76 (FIG. 4) that define the groove 70).

Figure 8:
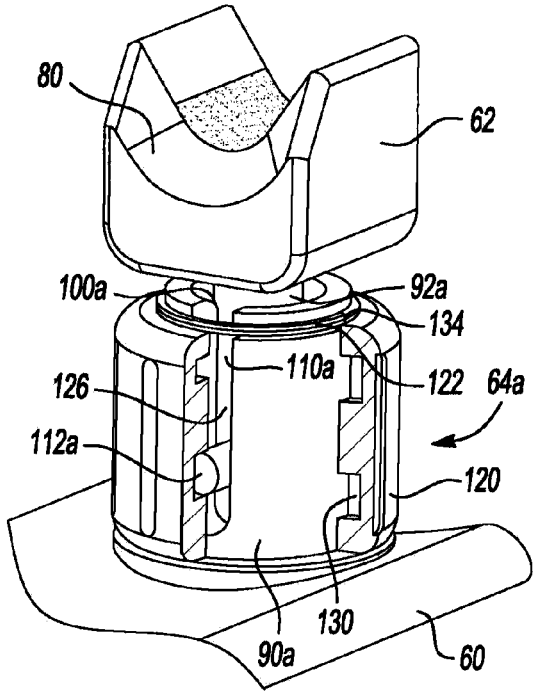
FIG. 8 is a perspective, partially sectioned view of the adjustment mechanism of FIG. 7.

FIGS. 7 and 8 illustrate an alternative adjustment mechanism 64*a* that can include a cylinder 90*a*, a piston 92*a*, an adjustment ring 120 and a snap ring 122. The cylinder 90*a* can be coupled to the leg 60 and can define a hollow cylindrical interior chamber 100*a* and a longitudinally extending guide slot 126. The piston 92*a* can include a first portion 110*a*, which can be received in the interior chamber 100*a* and fixedly but non-rotatably engaged to the fastener guide 62, and a second portion 112*a* that can extend generally perpendicular to the first portion 110*a* into the guide slot 126. The adjustment ring 120 can be received about the cylinder 90*a* and can include an internal helical groove or thread 130 into which the second portion 112*a* of the piston 92*a* can be received. The snap ring 122 can be fitted into a circumferential groove 134 formed about the cylinder 90*a* and can inhibit removal of the adjustment ring 120 from the cylinder 90*a*. Rotation of the adjustment ring 120 can effect corresponding vertical motion of the second portion 112*a* to permit a user to selectively raise or lower the piston 92*a* and the fastener guide 62.

Figure 9:
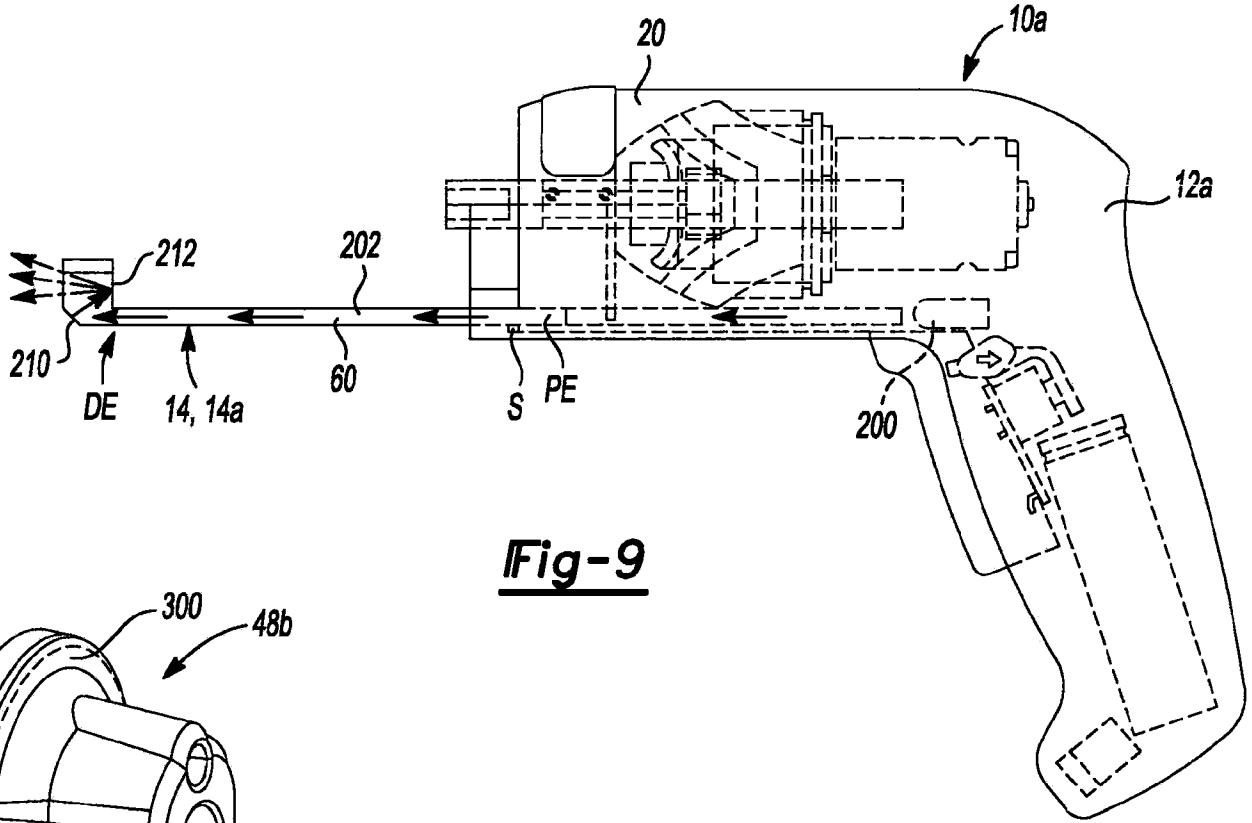
FIG. 9 is a schematic illustration of another exemplary tool assembly constructed in accordance with the teachings of the present disclosure.

In FIG. 9, the tool assembly 10*a* can be generally similar to the tool assembly 10 (FIG. 1) except that the driving tool 12*a* can include a light source 200 and the holder assembly 14*a* can include a light pipe 202. The light source 200, which can include one or more light emitting diodes, can be electrically coupled to the battery 28 and the trigger switch 50 and can generate light that can be transmitted into the light pipe 202. The light pipe 202 can be a discrete structure that can be coupled to the leg 60 or could be integrally formed with the leg 60. The light pipe 202 can be formed of a transparent material, such as polycarbonate, and configured to capture light generated by the light source and to transmit the captured light to the distal end DE of the light pipe 202. The distal end DE of the light pipe 202 can be configured with various features to reflect, direct and diffuse the light transmitted through the light pipe 202 in a desired manner. For example, a first surface 210 on the distal end DE of the light pipe 202 can be configured to totally internally reflect the light that is transmitted through the light pipe 202 to a second surface 212, and the second surface 212 can be configured to diffuse the reflected light in a desired manner so as to permit a workpiece (not shown) to be illuminated in a desired area. It will be appreciated that coatings can be applied to the light pipe 202 and to the interior of the housing 20 to increase the amount of light that is captured and/or retained by the light pipe 202. For example, the interior surfaces of the housing 20 and the longitudinally extending exterior surfaces can be painted white to reflect light (in the housing 20 and/or in the light pipe 202).

Figure 10:
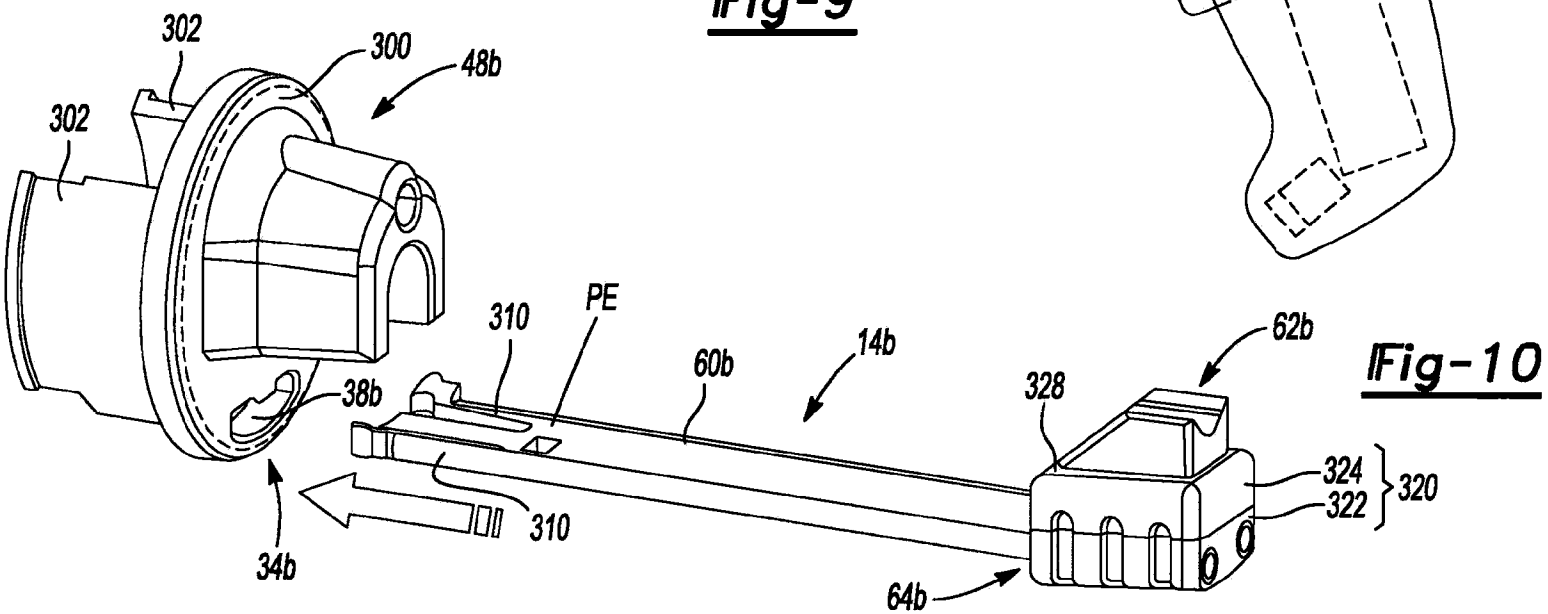
Figure 11:
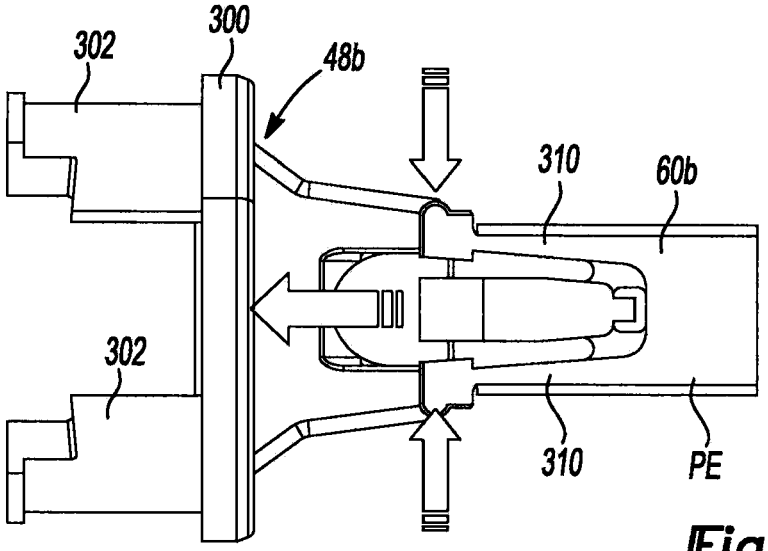

A portion of another tool assembly constructed in accordance with the teachings of the present disclosure is illustrated in FIGS. 10 through 23. Portions of the tool assembly not described herein can be similar or identical to those of the tool assembly 10 described above and/or the tool assembly 810 described in more detail below. With specific reference to FIGS. 10 and 11, the nose 48*b* of the driving tool is illustrated to include a front flange 300 and a pair of spring arms 302. The front flange 300 can include a mount 34*b* having a longitudinally extending slot 38*b* into which the leg 60*b* of the holder assembly 14*b* can be received. The holder assembly 14*b* can be generally similar to the holder assembly 14 (FIG. 1) described above except as noted below. The proximal end PE of the leg 60*b* can include a pair of resilient locking legs 310 that can be squeezed toward one another as illustrated in FIG. 11 to permit the proximal end PE of the leg 60*b* to be received into the longitudinally extending slot 38*b*. The adjustment mechanism 64*b* can include a two-piece container-like structure 320 having a lower portion 322 that is sized to receive a biasing spring (not specifically shown) and the fastener guide 62*b*, and an upper portion 324 that can define a window 328 through which a portion of the fastener guide 62*b* can extend. While not shown, it will be appreciated that the fastener guide 62*b* can include a flange that can extend about its perimeter; the flange can be sized larger than the size of the window 328 so that the biasing spring does not push the fastener guide 62*b* out of the container-like structure 320.

Figure 12:
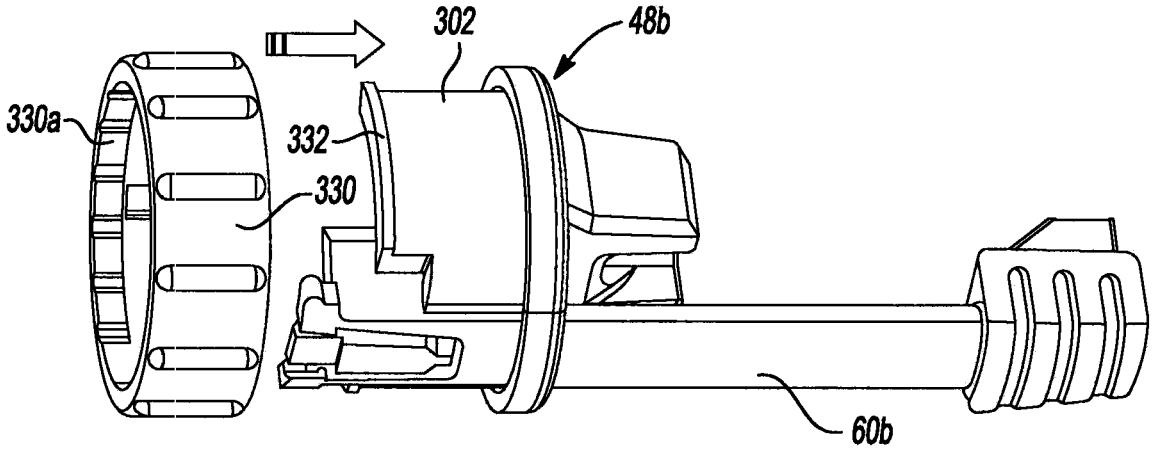
Figure 13:
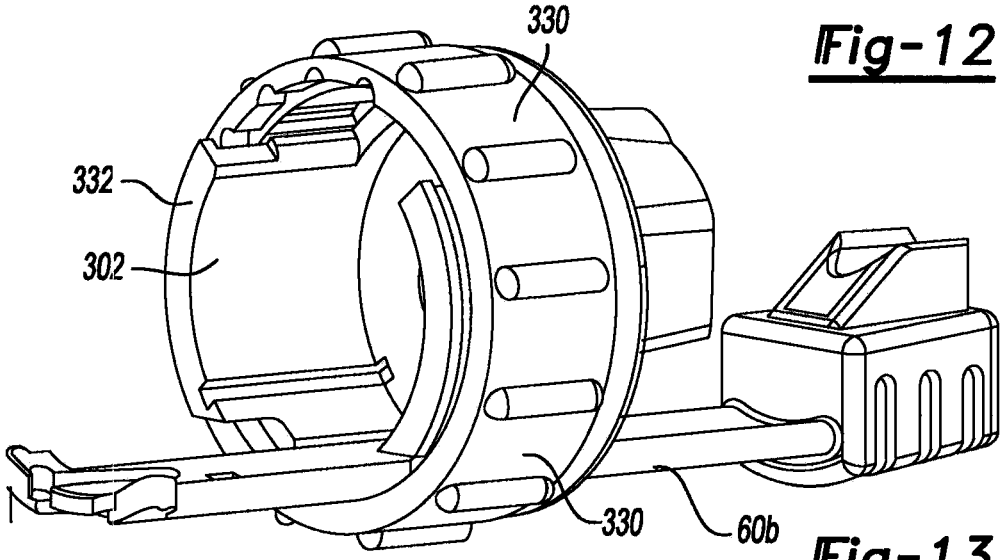

With reference to FIGS. 12 and 13, a clutch ring 330 can be pushed onto the spring arms 302 to rotatably couple the clutch ring 330 to the nose 48*b*. As will be appreciated, the clutch ring 330 is configured to receive an input from an operator to set a clutch (e.g., clutch 25 in FIG. 17) to a selected clutch setting from a plurality of clutch settings. The spring arms 302 include radially outwardly extending ribs 332 that cooperate to define an outside diameter that is larger than an inside diameter of the clutch ring 330. Contact between the clutch ring 330 and the ribs 332 causes the spring arms 302 to deflect inwardly, but the spring arms 302 can deflect outwardly when the clutch ring 330 passes over the ribs 332. In this condition, the ribs 332 can prevent the clutch ring 330 from being removed from the nose 48*b*. Once rotatably coupled to the nose 48*b*, the clutch ring 330 can be sized such that an inside surface 330*a* of the clutch ring 330 supports the lower surface 68*b* of the leg 60*b*.

Figure 14:
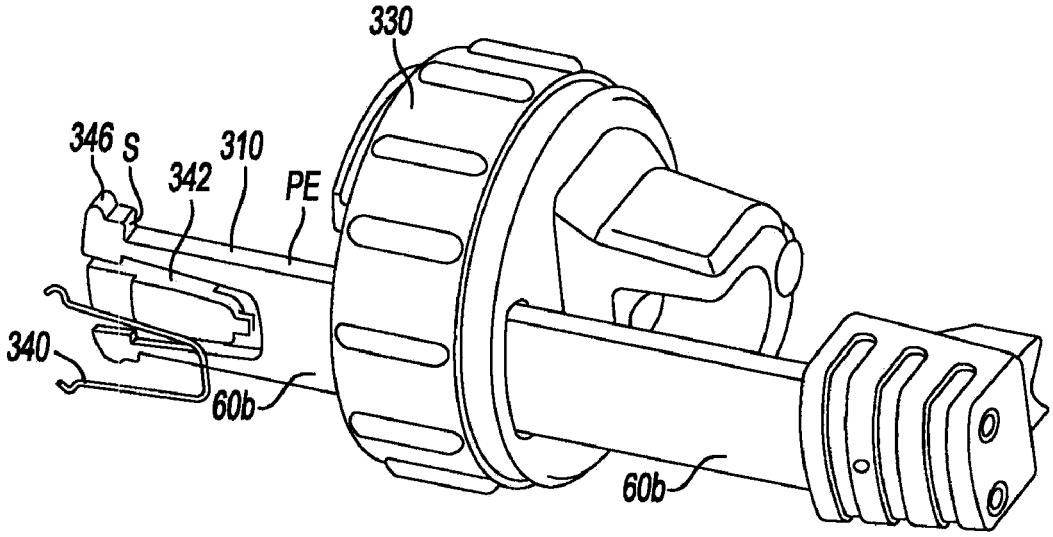
Figure 15:
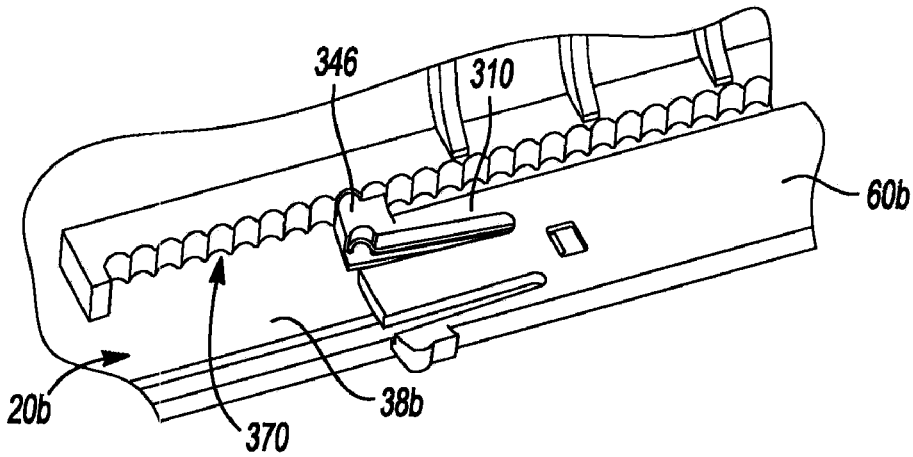
Figure 16:
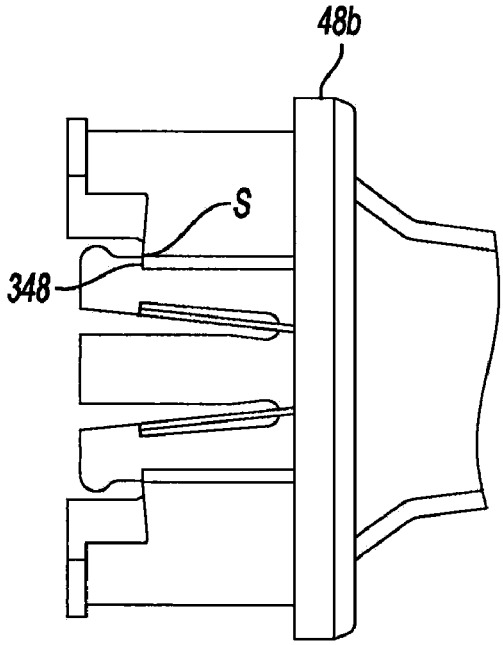
Figure 17:
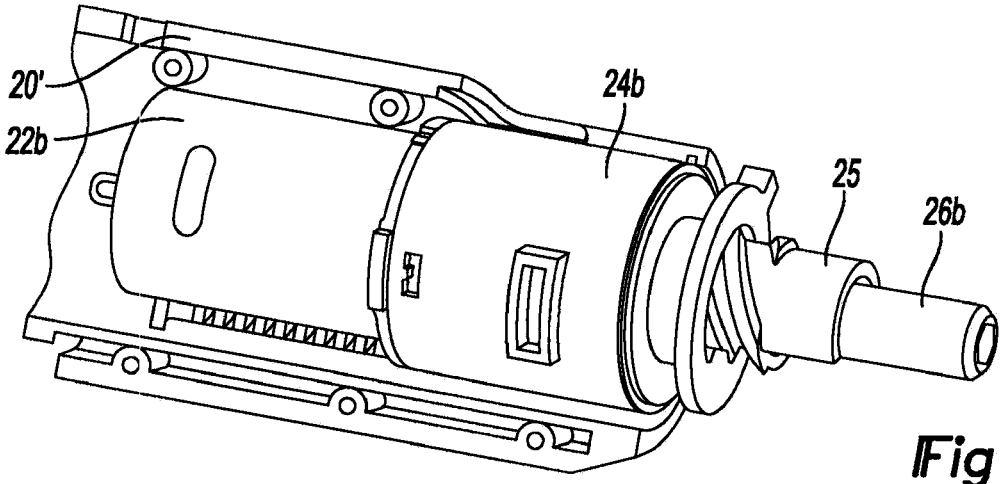
Figure 18:
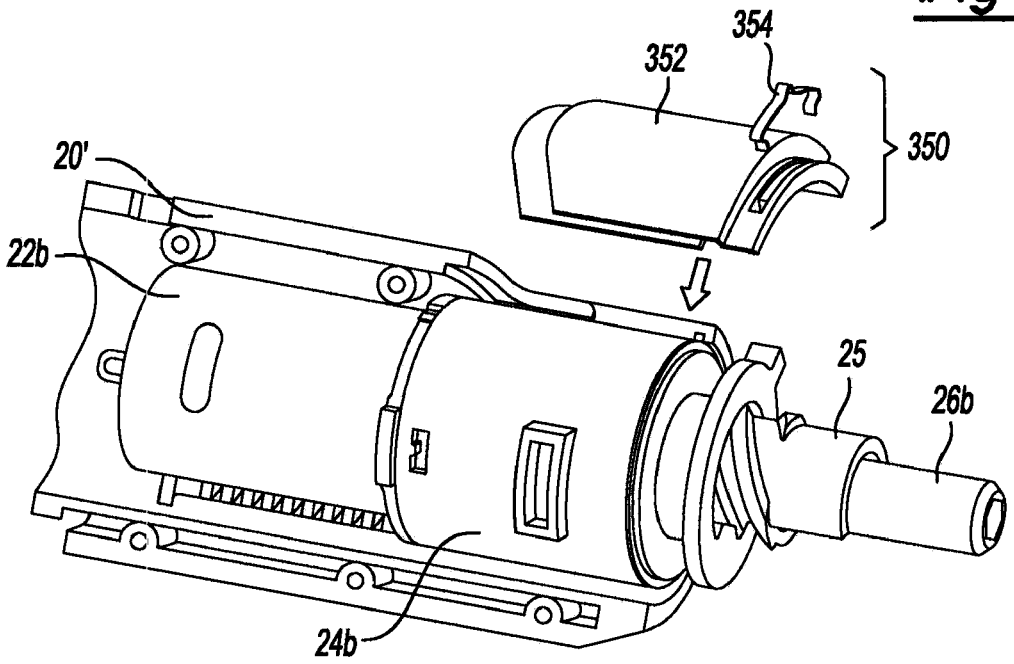
Figure 19:
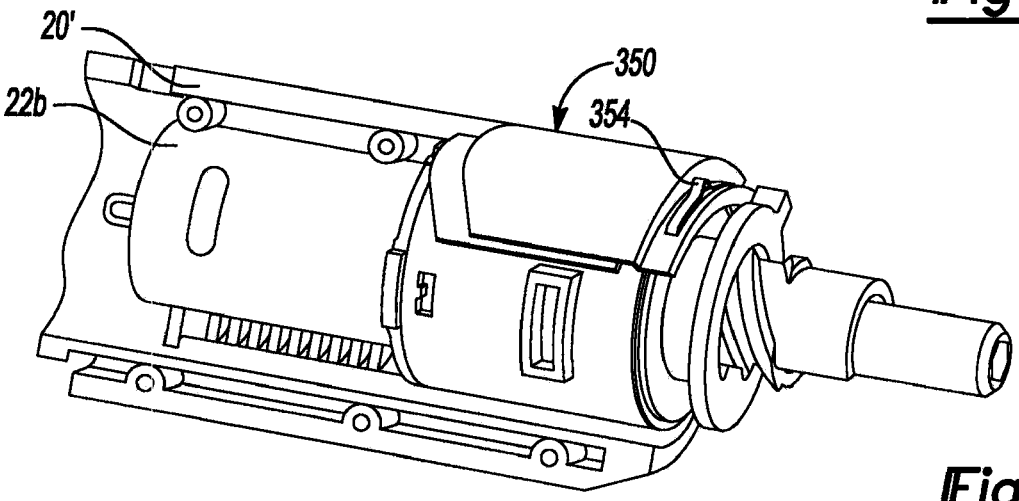

In FIGS. 14 and 16, a spring 340 can be coupled to the proximal end PE of the leg 60*b* to assist in biasing the locking legs 310 in an outward direction. In the example provided, the spring 340 is a resilient wire spring that is received into a spring groove 342 that is formed in the proximal end PE of the leg 60*b*. The outwardly biased locking legs 310 include a stop S and detent 346. The stop S can be abutted against corresponding ledges 348 defined by the nose 48*b* to inhibit removal of the leg 60*b* from the nose 48*b*.

In FIGS. 17-24, a motor 22*b*, a transmission 24*b*, a clutch 25 and an output member 26*b* can be assembled and installed to a clam shell half 20'. Those of skill in the art will appreciate that the clam shell half 20' can form a portion of the housing (not specifically shown) of the driving tool (not specifically shown). A switching assembly 350, which can include a switch member 352 and a spring 354, can be coupled to the clam shell half 20'.

In FIGS. 20 through 23 subassembly of the motor 22*b*, transmission 24*b*, clutch 25, output member 26*b*, clam shell half 20' and switching assembly 350 can be coupled to the nose 48*b* and the clutch ring 330. The output member 26*b* can be received into the nose 48*b*, a clutch nut 360 can be aligned to a longitudinally extending groove 362 in the clutch ring 330 and the spring 354 can be received into one of a plurality of detent grooves 368 formed in the clutch ring 330. With additional reference to FIG. 15, the detents 346 of the locking legs 310 can be engaged to a longitudinally extending detent track 370 that can define a side of the longitudinally extending slot 38*b* in the housing 20*b*. The detent track 370 can comprise a plurality of detent members, such as grooved surfaces, that can matingly engage a corresponding one of the detents 346 to position the leg 60*b* in a desired position relative to the housing 20*b*. Engagement of the detents 346 to the detent tracks 370 can provide the user with tactile and audible feedback as the position of the leg 60*b* is changed, as well as control side play between the leg 60*b* and the housing 20*b*.

Figure 20:
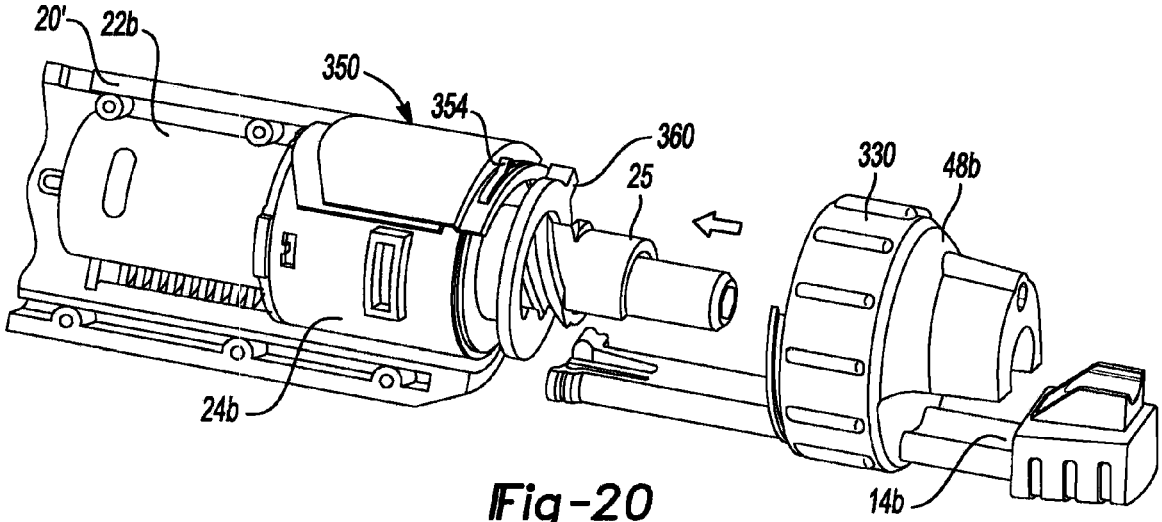
Figure 21:
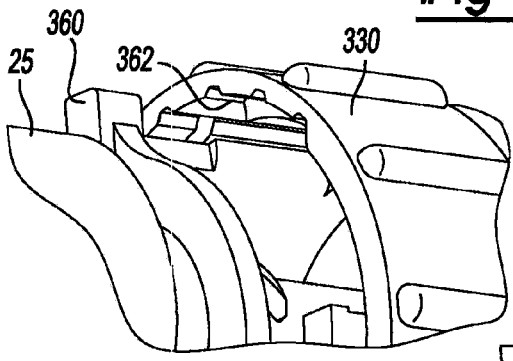
Figure 22:
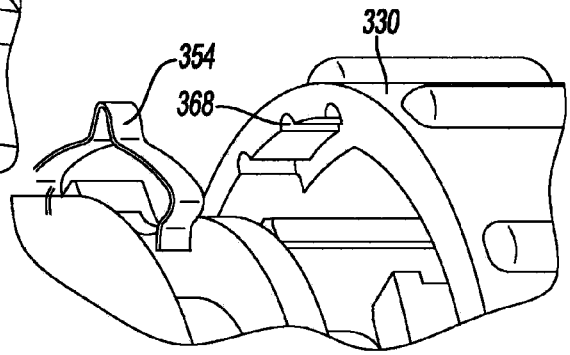
Figure 23:
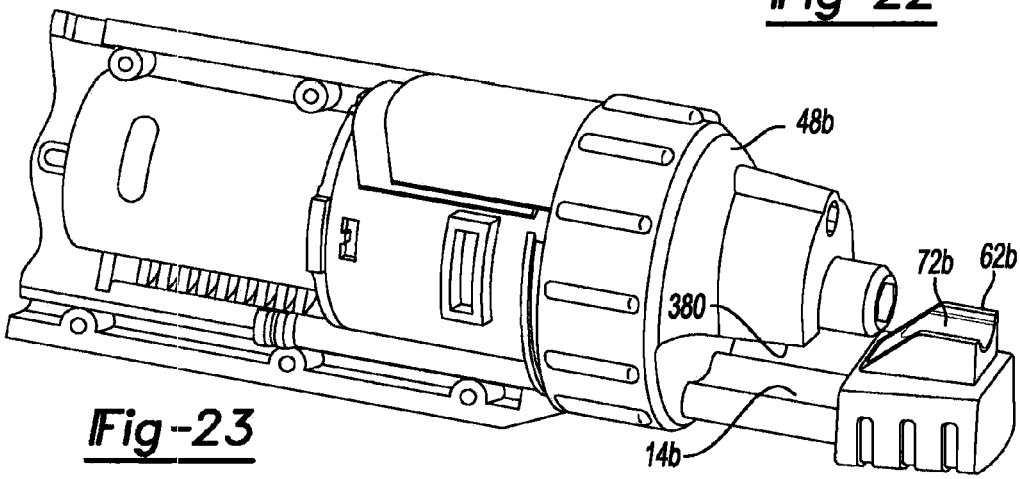
Figure 24:
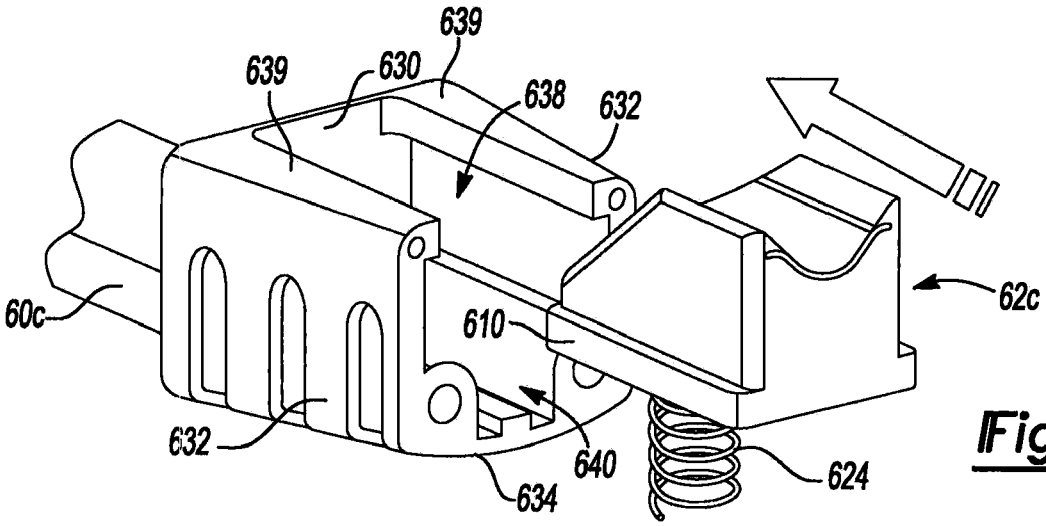

With specific reference to FIGS. 20 and 23, positioning of the holder assembly 14*b* into the fully retracted position will permit a cam 380 on the nose 48*b* to contact the cam 72*b* of the fastener guide 62*b* to urge the fastener guide 62*b* vertically downward into a retracted position.

With specific reference to FIG. 23, the tool assembly 10*b* can include a light source 500, which can include a light emitting diode or other suitable light source, which can be housed in the housing 20*b* and selectively activated to illuminate a desired area. In the example provided, the light source 500 is selectively activated by depressing the trigger switch 50 and once illuminated, the light source 500 can be maintained in an illuminated condition for a predetermined amount of time via a timer (not shown) that can be electrically coupled to the power source of the tool, such as a batter, as well as the trigger switch 50 and the light source 500.

Figure 25:
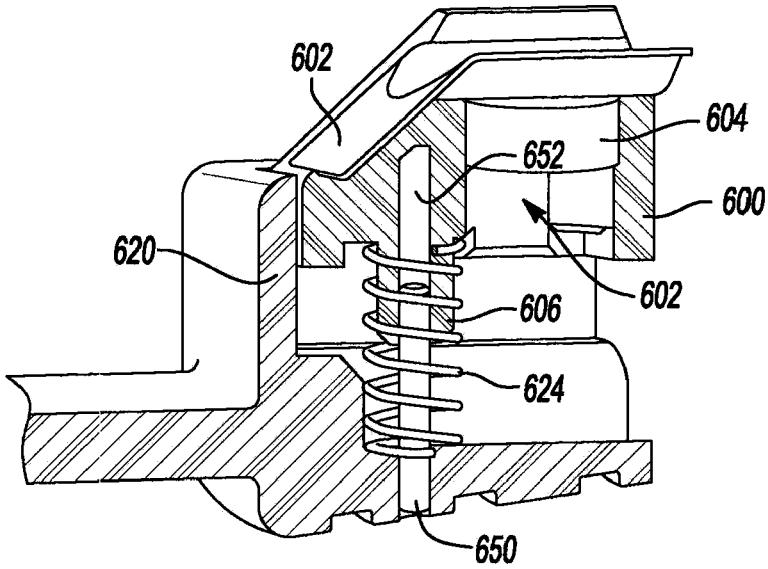
Figure 26:
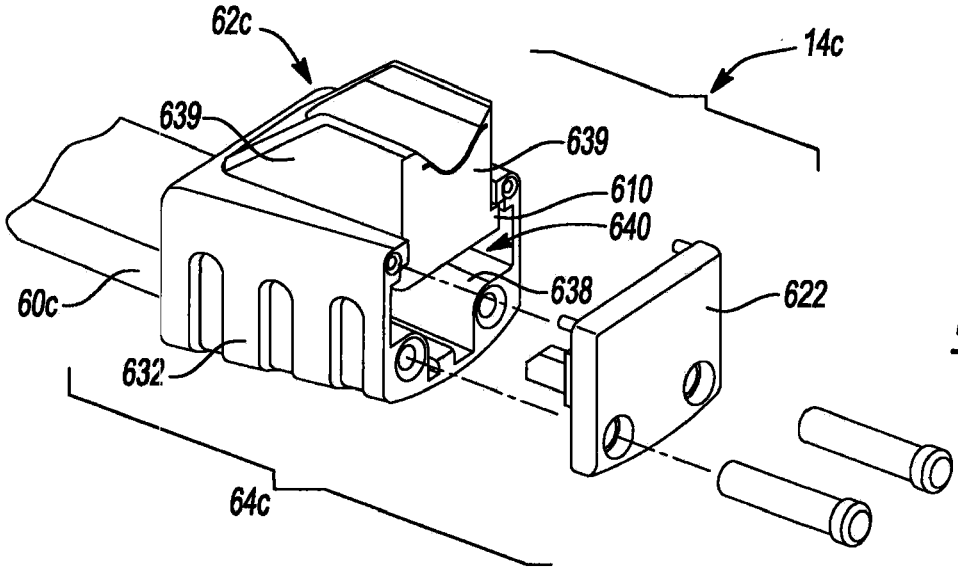
Figure 27:
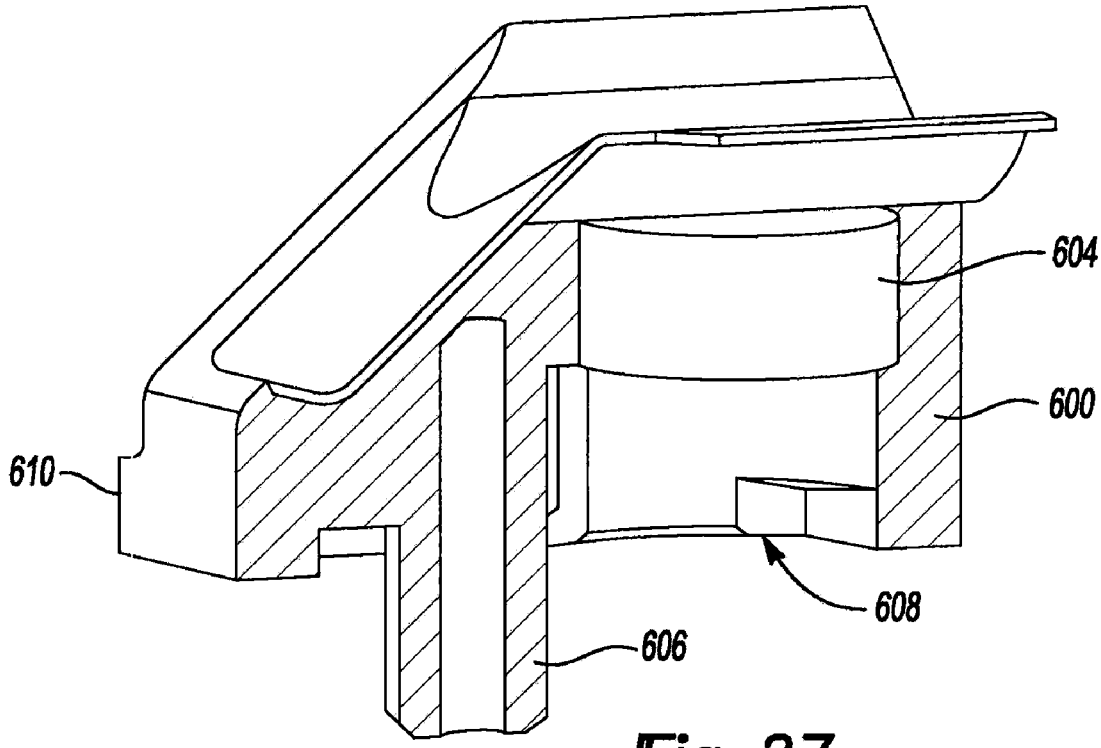
Figure 28:
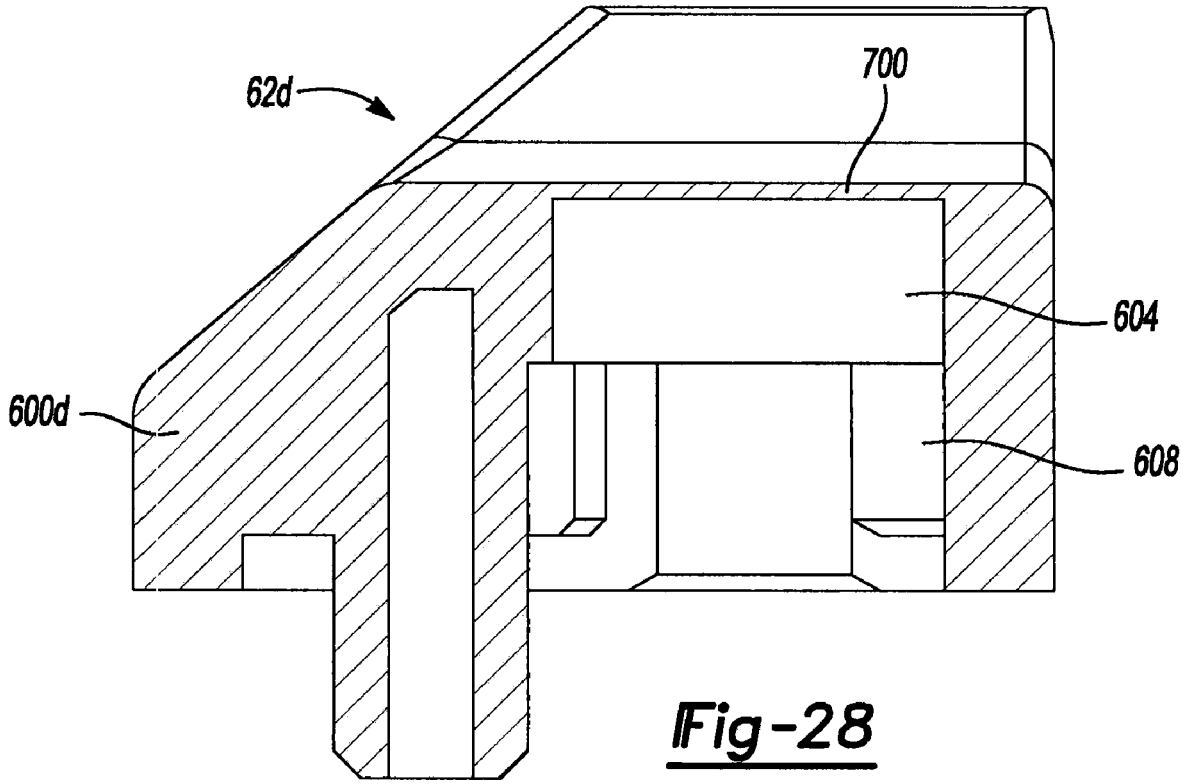
FIG. 28 is a section view similar to that of FIG. 25 but illustrating a differently constructed fastener guide.

In FIGS. 24 through 27, construction of an alternate holder assembly 14*c* is illustrated. The holder assembly 14*c* can include a leg 60*c*, a fastener guide 62*c* and an adjustment mechanism 64*c*. With reference to FIGS. 25 and 28, the fastener guide 62*c* can include a molded plastic body 600, a wear plate 602 that can be formed of a suitable material, such as stainless steel, and a magnet 604. The wear plate 602 can be coupled to the body 600 in any desired manner, such as via insert molding. The body 600 can define a spring guide 606, a magnet aperture 608 that can be configured to receive the magnet 604, and a pair of flanges 610 that can extend along the lateral sides of the fastener guide 62*c*.

The adjustment mechanism 64*c* can include a first housing portion 620, a second housing portion 622, a spring 624 and a pair of fasteners 626. The first housing portion 620 can be integrally formed with the leg 60*c* and can include a front wall 630, a pair of side walls 632 and a bottom wall 634 that cooperate to define a cavity 638. The side walls 632 can include a portion 639 that can extend into the cavity 638. The spring 624 can be mounted on the spring guide 606 and the fastener guide 62*c* can be slidably received through the open end 640 of the first housing portion 620 in a direction that can be generally parallel to the side walls 632. It will be appreciated that the spring 624 can contact the bottom wall 634 and urge the fastener guide 62*c* upwardly in the cavity 638. Contact between the flanges 610 and the inwardly extending portions 639 of the side walls 632 can limit movement of the fastener guide 62*c* in a direction outwardly from the cavity 638 as shown in FIG. 27. The second housing portion 622 can be a cover-like structure that can be configured to close the open end 640 of the first housing portion 620. In the example provided, the fasteners 626 are employed to fixedly but removably couple the second housing portion 622 to the first housing portion 620.

Optionally, a guide pin 650, such as a roll pin, can be received through and engaged to the leg 60*c*/first housing portion 620 and received into a guide hole 652 that can be formed in the spring guide 606. The guide pin 650 can cooperate with the fastener guide 62*c* to ensure that the fastener guide 62*c* travels only in a direction parallel to the guide pin 650.

The example of FIG. 28 illustrates yet another fastener guide 62*d*. In this example, the fastener guide 62*d* is generally similar to the fastener guide 62*c* (FIG. 25) except that it includes a body 600*d* that is unitarily formed of a suitable material, such as zinc and the area 700 above the magnet aperture 608 can be relatively thin so that the magnetic field of the magnet 604 will be sufficiently strong so as to retain a fastener (not shown) to the fastener guide 62*d*.

Figure 29:
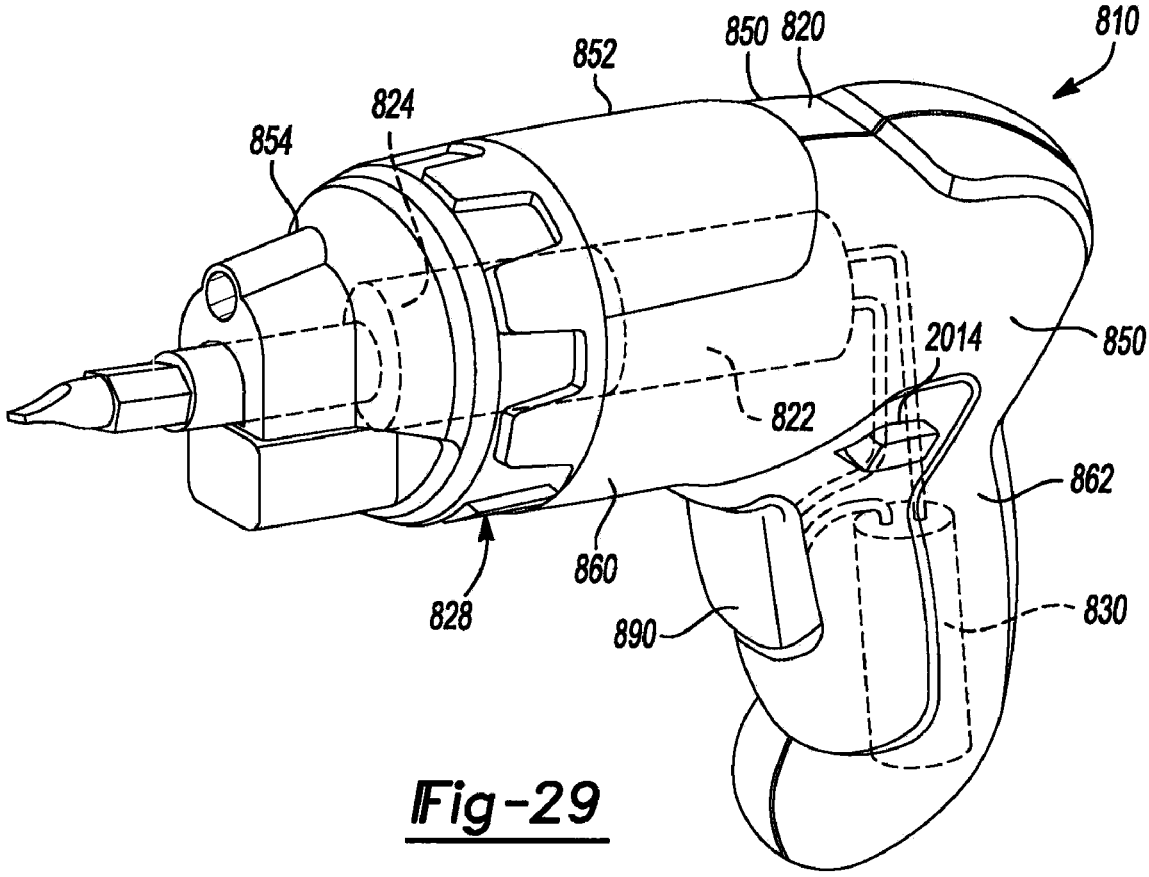
FIG. 29 is a perspective view of another exemplary driving tool constructed in accordance with the teachings of the present disclosure.

With reference to FIG. 29 of the drawings, a driving tool constructed in accordance with the teachings of the present invention is generally indicated by reference numeral 810. The driving tool 810 can be any type of tool that is configured to provide a rotary output, such as a nutrunner, a screwdriver, a drill/driver or a hammer-drill/driver, and can be powered by any desired means, including electrically, pneumatically and/or hydraulically. In the particular example provided, the driving tool 810 is a battery-powered screwdriver that includes a housing assembly 820, an electric motor 822, a transmission assembly 824, an output member 826, a clutch assembly 828 and a battery 830. The motor 822 and the battery 830 can be conventional in their construction and as such, need not be discussed in detail herein.

Figure 30:
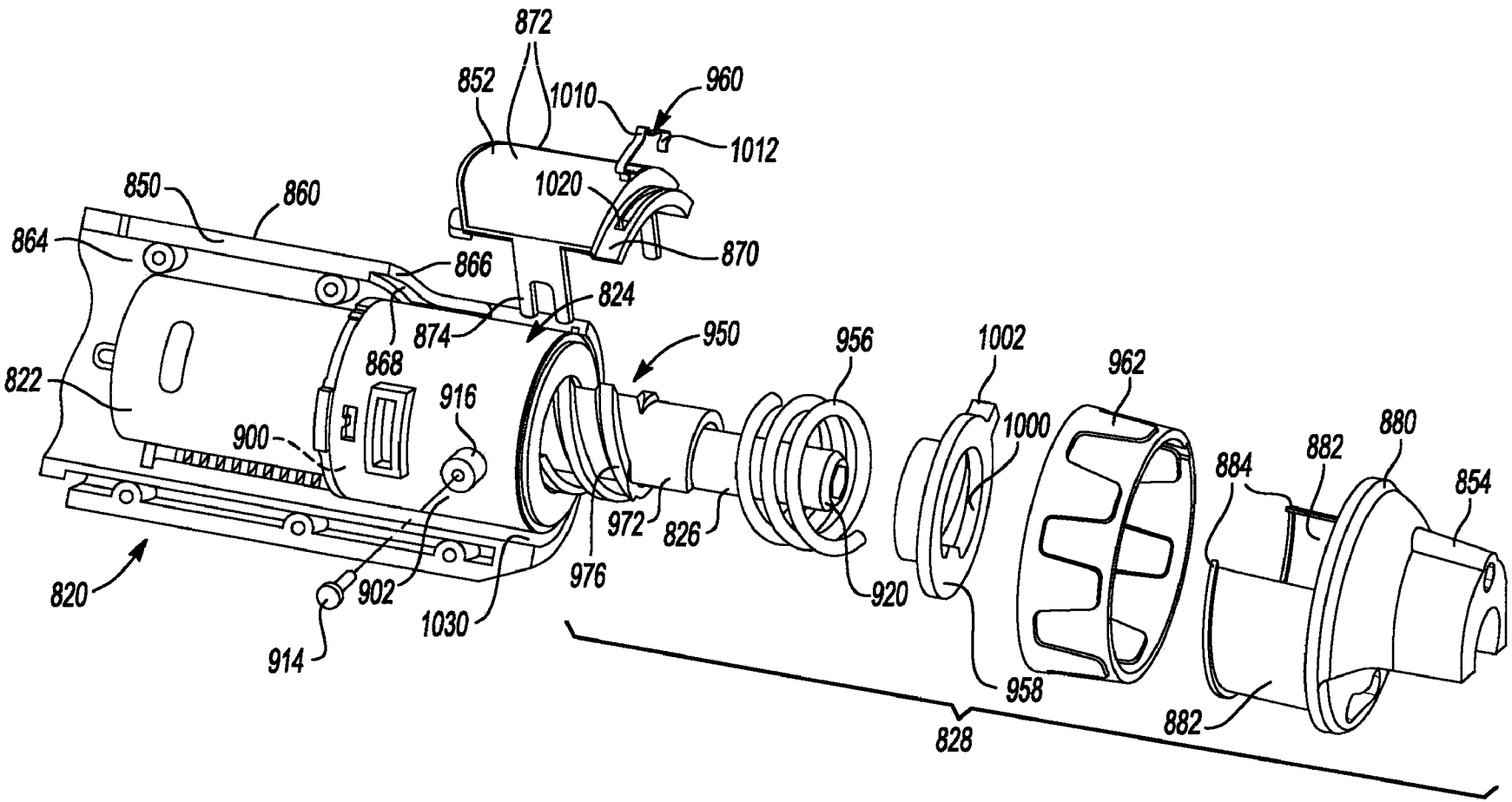
FIG. 30 is an exploded perspective view of a portion of the driving tool of FIG. 29.

With additional reference to FIG. 30, the housing 820 can include a pair of housing shells 850, a fascia member 852 and a nose 854. The housing shells 850 can cooperate to define a body 860 and a handle 862 (shown in FIG. 29). The body 860 can define a cavity 864 into which the motor 822 and the transmission assembly 824 can be received, and a fascia aperture 866 at an end of the body 860 opposite the handle 862. The handle 862 can have a cavity (not specifically shown) into which the battery 830 can be received. The fascia member 852 can be configured to close the fascia aperture 866 and can be received between the housing shells 850 in corresponding grooves 868 that are formed in the housing shells 850. The fascia member 852 can include a spring mount 870, a plurality of clutch setting indicia 872 and a pair of yokes 874. The clutch setting indicia can be integrally formed with a remainder of the fascia member 852 and/or could be coupled to the remainder of the fascia member 852 in a suitable manner (e.g., adhesively coupled, hot-stamped). The nose 854 can include a front flange 880 and a pair of spring arms 882. A first end of the spring arms 882 can be coupled to the front flange 880, while a radially extending rib 884 can be formed on a second end opposite the front flange 880.

A conventional trigger switch 890 (shown in FIG. 29) can be electrically coupled to the battery 830 and the motor 22 and can be housed in the housing 820. The trigger switch 890 can be employed to selectively distribute electrical energy from the battery 830 to the motor 822.

Figure 31:
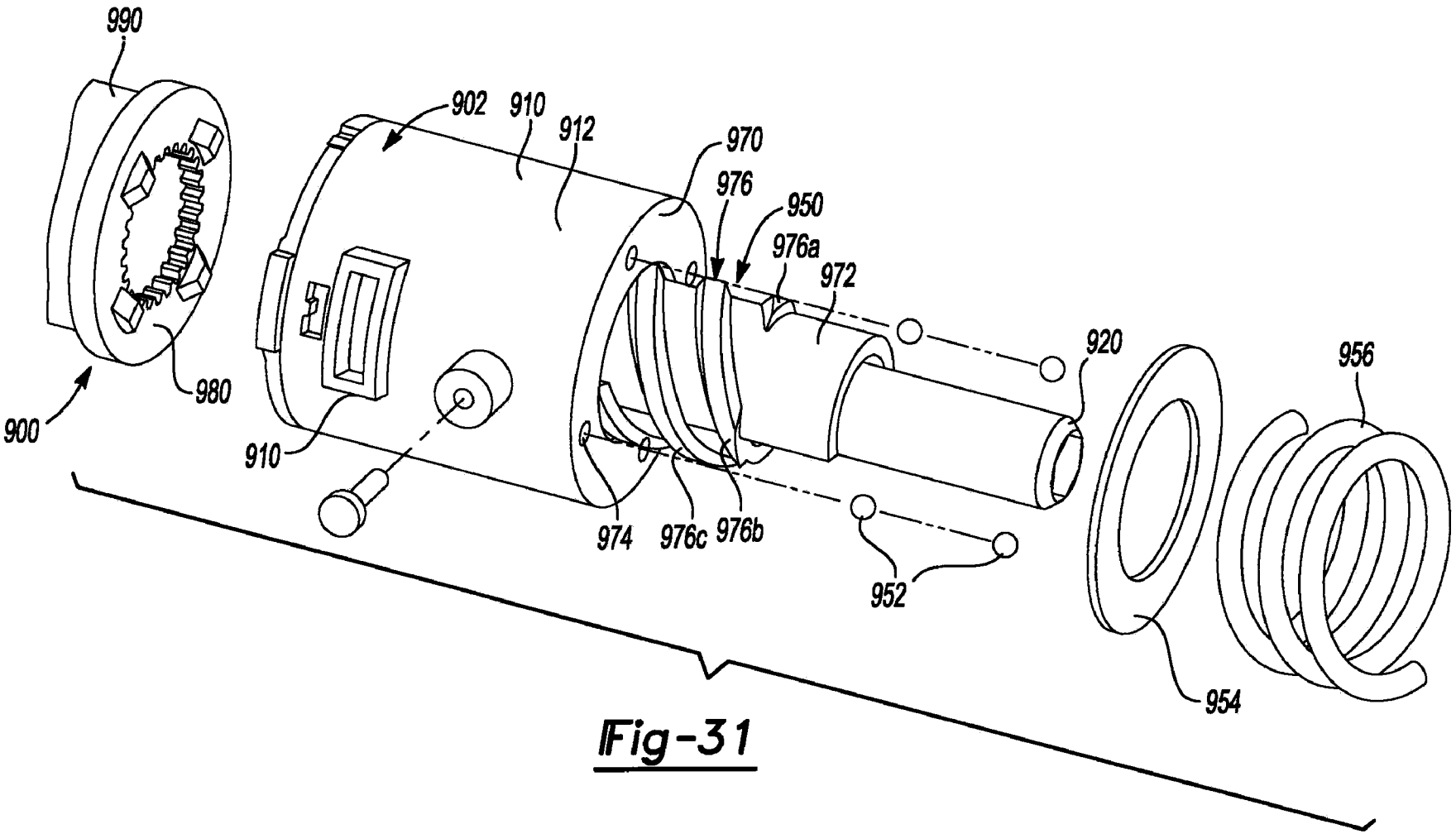
FIG. 31 is an exploded perspective view of a portion of the driving tool of FIG. 29, illustrating portions of the transmission assembly and the clutch assembly in more detail.

With reference to FIGS. 30 and 31, the transmission assembly 824 can include a transmission 900 and a gear case 902. The transmission 900 can be any type of transmission, but in the example provided is a one-speed, three-stage planetary-type transmission that receives an input from the motor 822 and provides a rotary output to the output member 826. The gear case 902 can be configured to house the transmission 900. In the particular example provided, the gear case 902 includes a shell member 910 that defines a circumferentially extending wall 912 within which the transmission 900 is retained. The gear case 902 can be coupled to the motor 822 in a conventional and well known manner to align an output shaft (not shown) of the motor 822 to the transmission 900. The gear case 902 can also be coupled to the housing 820 in a conventional and well known manner (e.g., interconnecting features such as bosses and ribs) to inhibit axial and/or rotational movement of the transmission assembly 824 relative to the housing shells 850. In the particular example provided, a screw 914 can be received through an associated one of the housing shells 850 and threadably engaged to a boss 916 on the gear case 902. The yokes 874 of the fascia member 852 can be fitted over the bosses 916 to aid in axially securing the fascia member 852 to the housing shells 850; the yokes 874 are clamped between the housing shells 850 and the gear case 902 when the screws 914 are tightened.

The output member 826 can be any type of output member, such as a chuck. In the example provided, the output member 826 includes a hollow end 920 that is configured to receive and matingly engage a standard, commercially available tool bit (not shown) having a ¼ inch male hexagonal end.

The clutch assembly 828 can include a clutch body 950, a plurality of clutch elements 952, a thrust member 954, a clutch spring 956, a clutch nut 958, a detent spring 960 and an adjustment collar 962. The clutch body 950 can be integrally formed with the gear case 902 and can include an end wall 970 and a tubular externally threaded portion 972 through which the output member 826 can be received. The end wall 970 can close a side of the gear case 902 opposite the motor 822 and can include a plurality of thru-holes 974 through which the clutch elements 952 can be received. The externally threaded portion 972 has a plurality of parallel, non-connected threads 976. In the particular example provided, the externally threaded portion 972 has three parallel, non-connected threads 976*a*, 976*b* and 976*c* (i.e., a triple thread). The clutch elements 952 can be balls or pins and can be received in respective ones of the thru-holes 974 and abutted against a clutch face 980 that can be formed on an axial end of a ring gear 990 associated with a final stage (i.e., output stage) of the transmission 900. The thrust member 954 can be a washer that can be received over the externally threaded portion 972 of the clutch body 950 and abutted against clutch elements 952. The clutch spring 956 can be received over the externally threaded portion 972 of the clutch body 950 and can be abutted against the thrust member 954. The clutch nut 958 can be an annular structure having an internally threaded aperture 1000, which can be threadably engaged to the externally threaded portion 972 of the clutch body 950, and a radially outwardly extending post 1002.

Figure 32:
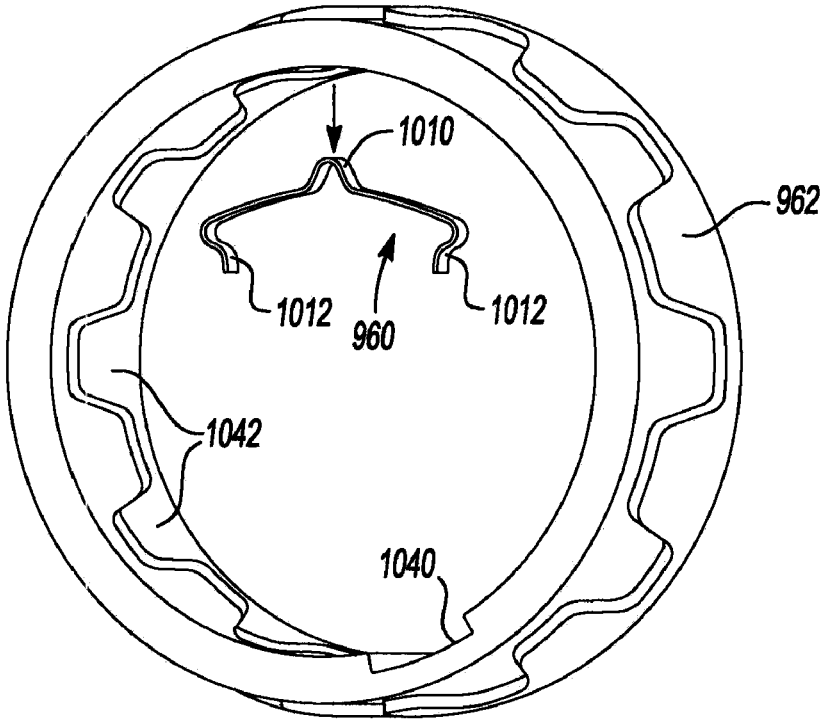
FIG. 32 is an exploded perspective view illustrating the assembly of the nose and the adjustment collar to the detent spring.

With reference to FIGS. 30 and 32, the detent spring 960 can be employed to resist movement of the adjustment collar 962 relative to the fascia member 852. In the particular example provided, the detent spring 960 is a leaf spring having a detent member 1010 and a pair of engagement members 1012 that are disposed on opposite sides of the detent member 1010. The engagement members 1012 can be engaged to a mounting structure 1020 formed on the spring mount 870 to thereby couple the detent spring 960 to the fascia member 852.

The adjustment collar 962 can be configured to receive a manual input from the user of the driving tool 812 and transmit the input to the clutch nut 958. The adjustment collar 962 can be an annular structure that can be rotatably mounted onto the spring arms 882 between the front flange 880 and the radially outwardly extending ribs 884. It will be appreciated from this disclosure that the adjustment collar 962 can be pushed onto the spring arms 882. Contact between the adjustment collar 962 and the ribs 884 will cause the spring arms 882 to deflect inwardly but the cantilevered spring arms 882 can deflect outwardly once the adjustment collar 962 has passed over the ribs 884. In this condition, the ribs 884 can prevent the adjustment collar 962 from being removed from the nose 854. The ribs 884 can also be engaged between corresponding ribs 1030 formed in the housing shells 850 to thereby couple the nose 854 to the housing shells 850. Accordingly, it will be appreciated that coupling the housing shells 850 to one another will simultaneously clamp or lock the fascia member 852 and the nose 854 to the housing shells 850.

The adjustment collar 962 can include a slot 1040, which can extend longitudinally through the adjustment collar 962, and a plurality of circumferentially spaced apart detent recesses 1042. The post 1002 can be received into the slot 1040 such that rotation of the adjustment collar 962 can cause corresponding rotation (and translation) of the clutch nut 958. It will be appreciated that in the alternative, the post 1002 could be coupled to the adjustment collar 962 and the slot 1040 could be formed in the clutch nut 958.

Figure 33:
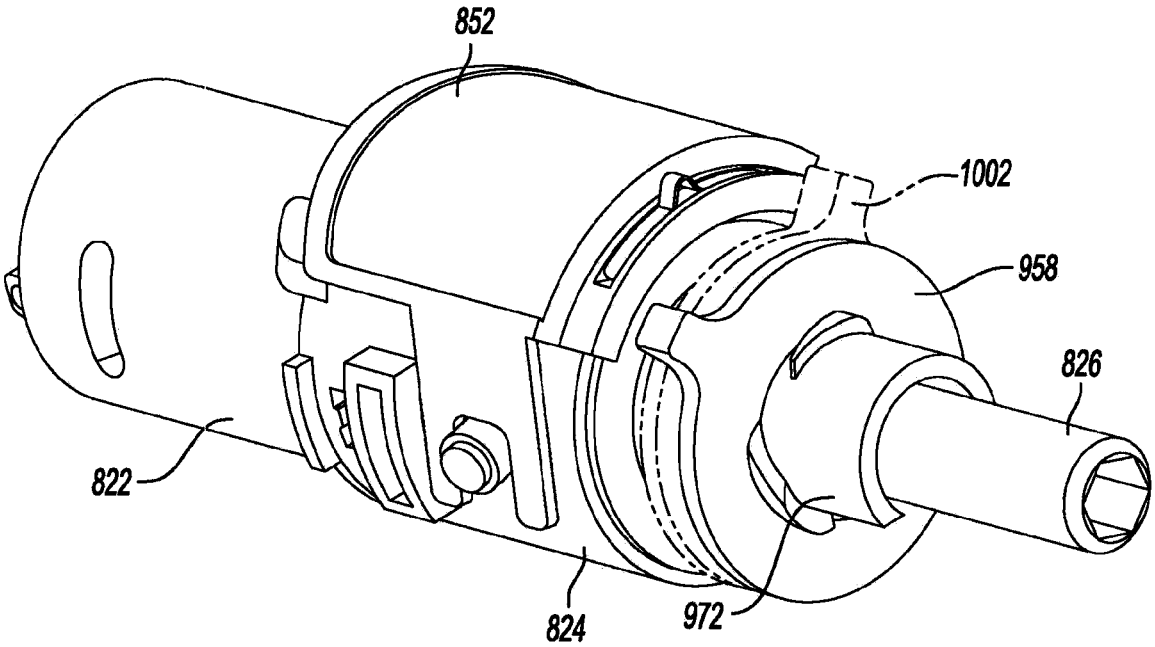
FIG. 33 is a perspective view of a portion of the driving tool of FIG. 29 illustrating the motor, transmission assembly and portions of the housing and the clutch assembly in more detail.
Figure 34:
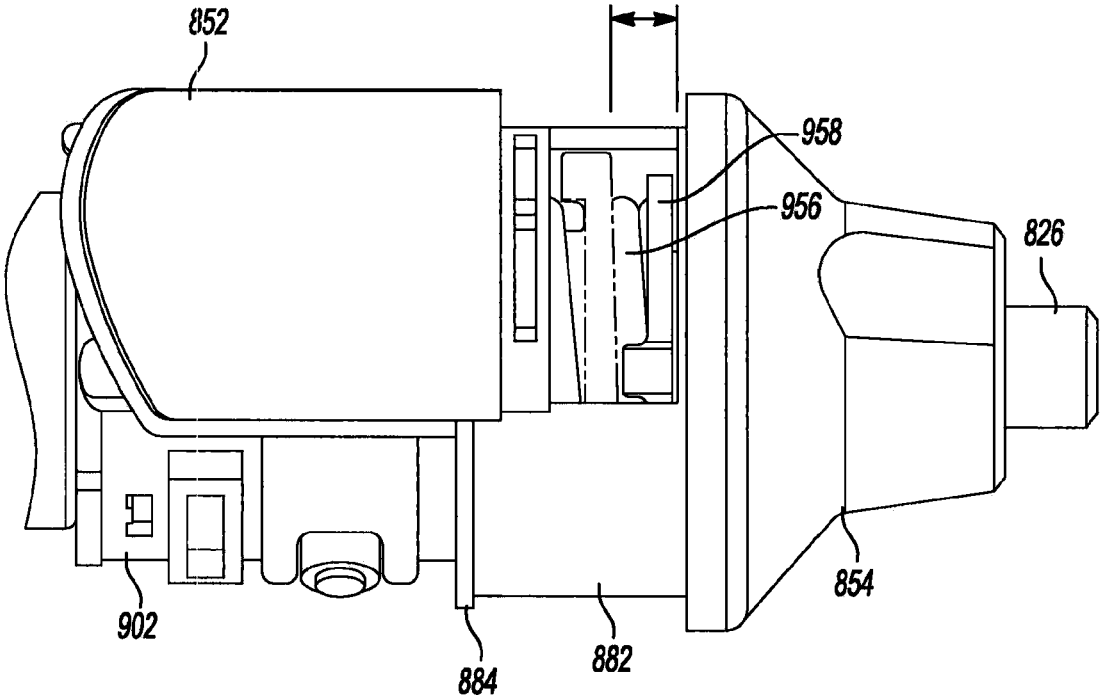
FIG. 34 is a side elevation view of a portion of the driving tool of FIG. 29, illustrating the motor, the transmission assembly and portions of the clutch assembly in more detail.
Figure 35:
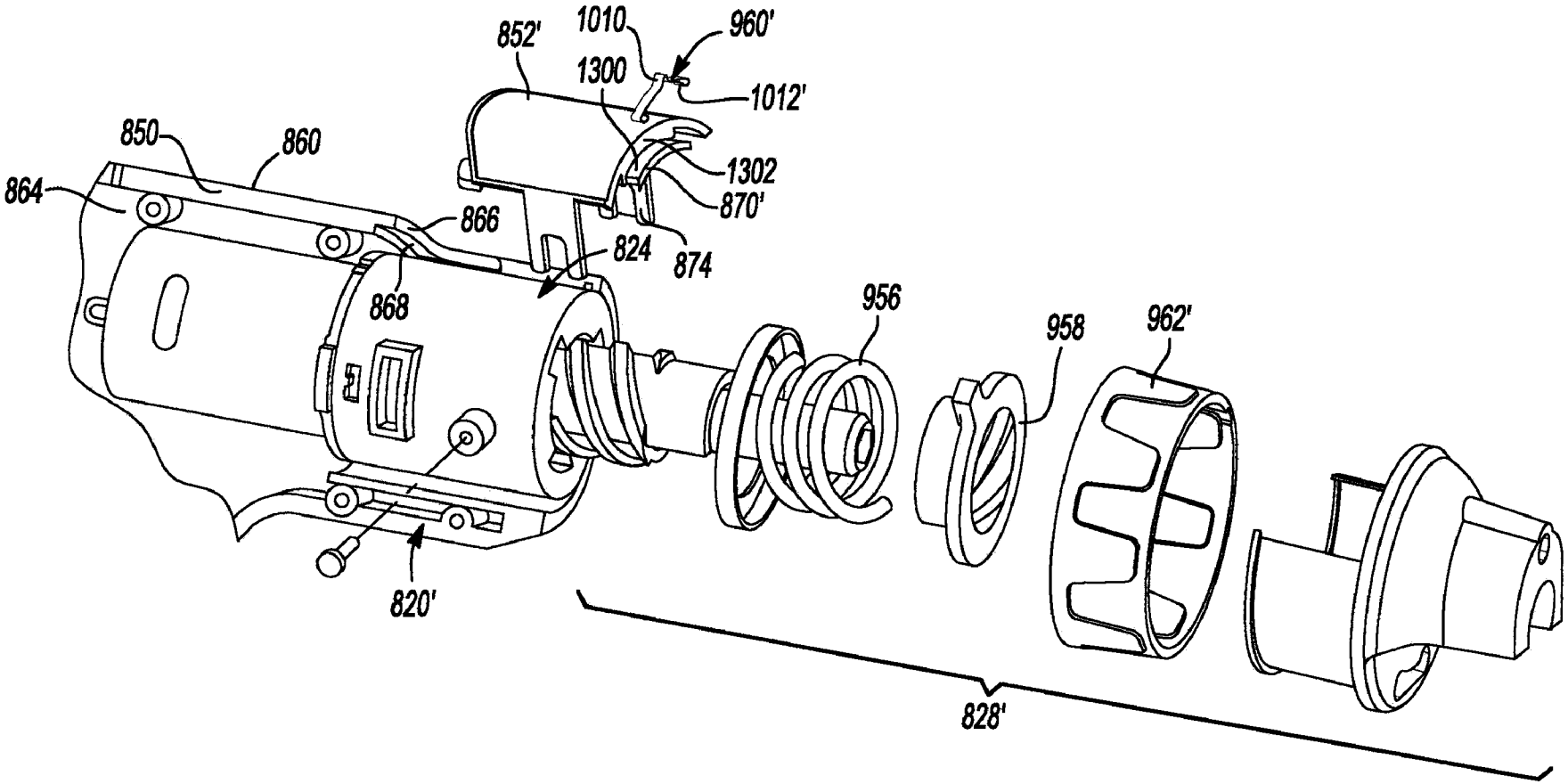
FIG. 35 is an exploded perspective view of a portion of another driving tool constructed in accordance with the teachings of the present disclosure.
Figure 36:
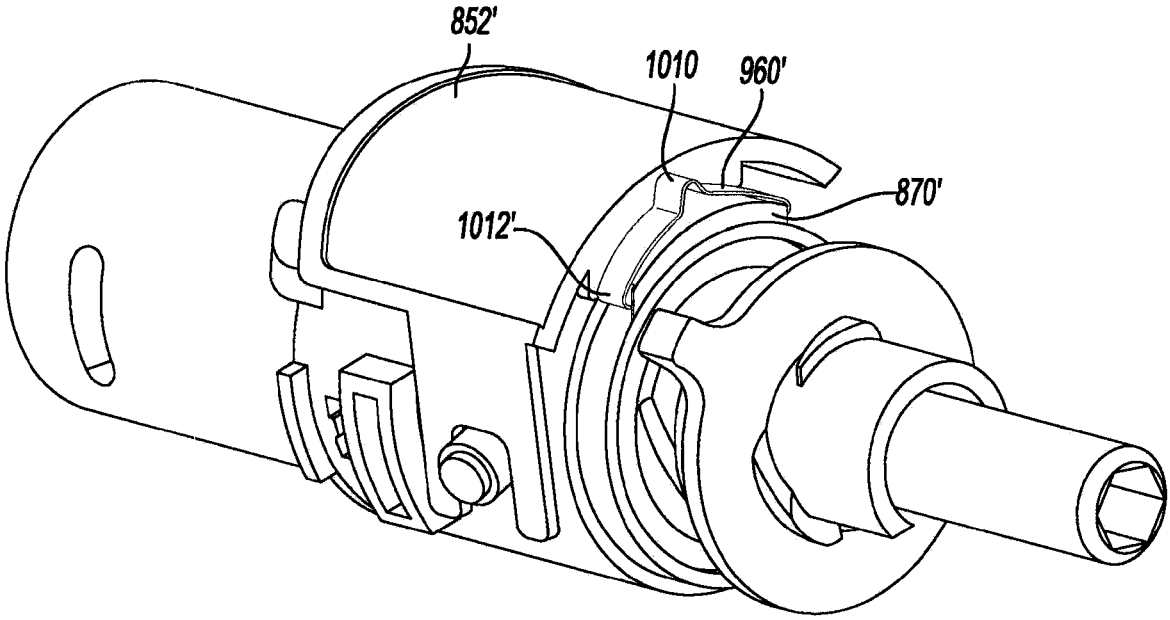
FIG. 36 is a perspective view of a portion of the driving tool of FIG. 35.
Figure 37:
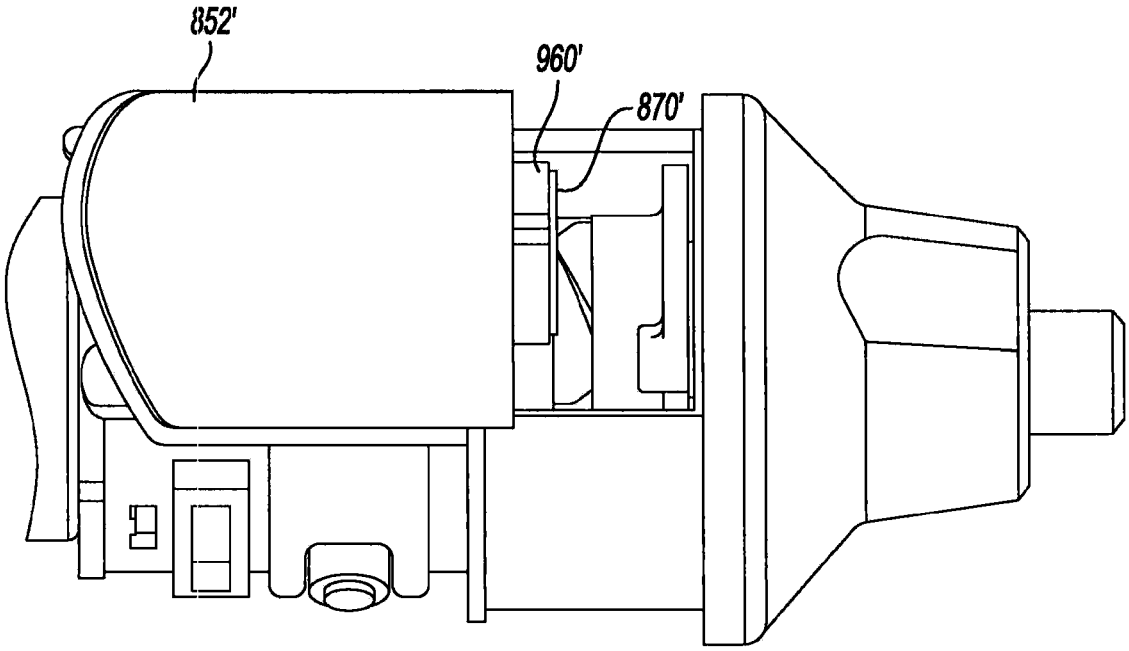
FIG. 37 is a side elevation view of a portion of the driving tool of FIG. 35, illustrating the motor, the transmission assembly and portions of the clutch assembly in more detail.
Figure 38:
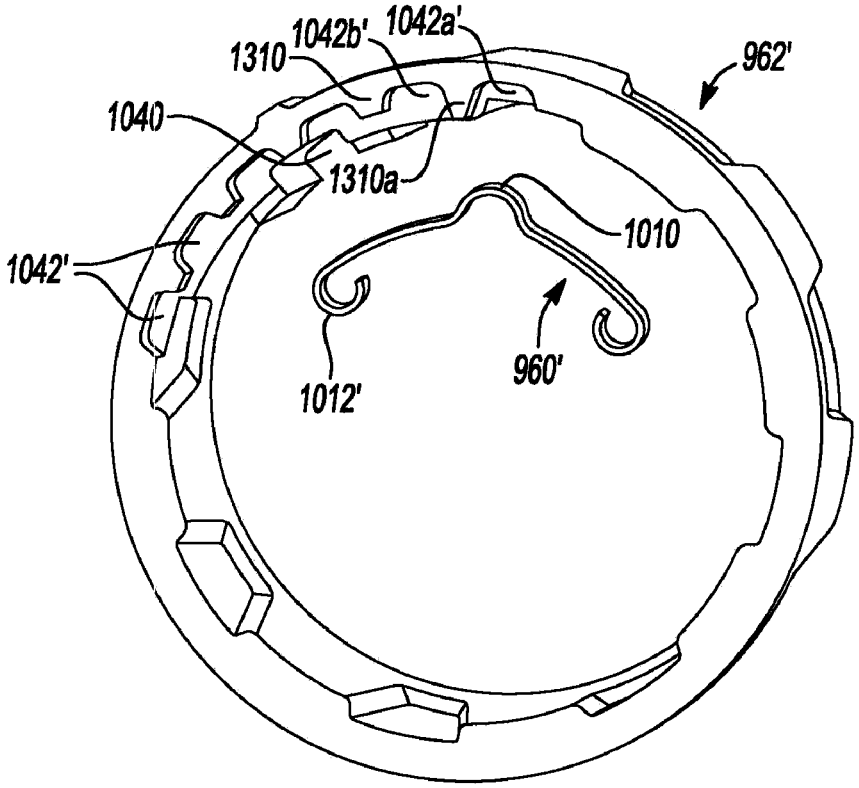
FIG. 38 is a perspective view of a portion of the driving tool of FIG. 35, illustrating portions of the clutch assembly in more detail.

The detent member 1010 of the detent spring 960 can be received into one of the detent recesses 1042 and can resiliently engage the adjustment collar 962 to resist relative rotation between the adjustment collar 962 and the clutch body 950. The detent member 1010 and the detent recesses 1042 permit the clutch nut 958 to be positioned along the externally threaded portion 972 of the clutch body 950 at a plurality of predetermined clutch settings, each of which being associated with a different clutch torque (i.e., a torque at which the clutch assembly 828 disengages to thereby limit torque transmission between the output member 826 and the transmission 900). The predetermined clutch settings include a maximum clutch setting (shown in FIGS. 33 and 34 in phantom line), a minimum clutch setting (shown in FIGS. 33 and 34 in solid line) and a plurality of intermediate clutch settings between the maximum and minimum clutch settings. It will be appreciated that in the alternative, the detent spring 960 could be carried by the adjustment collar 962, while the detent recesses 1042 could be formed in the housing 820.

Due to the multiple threads on the externally threaded portion 972 of the clutch body 950, rotation of the clutch nut 958 through a relatively small angle can cause a relatively large change in the axial position of the clutch nut 958 along the clutch body 950. For example, the multiple threads can permit the clutch nut 958 to be moved from a maximum clutch setting, through four intermediate clutch settings to a minimum clutch setting in approximately equal increments while being rotated through an angle of less than 90 degrees, such as 80 degrees. In the particular example provided, the plurality of predetermined clutch settings are spaced apart from one another by a distance of about 1 mm so that movement of the clutch nut 958 from a first one of the plurality of predetermined clutch settings to a second, adjacent one of the clutch settings changes a length of the clutch spring by about 1 mm.

Figure 39:
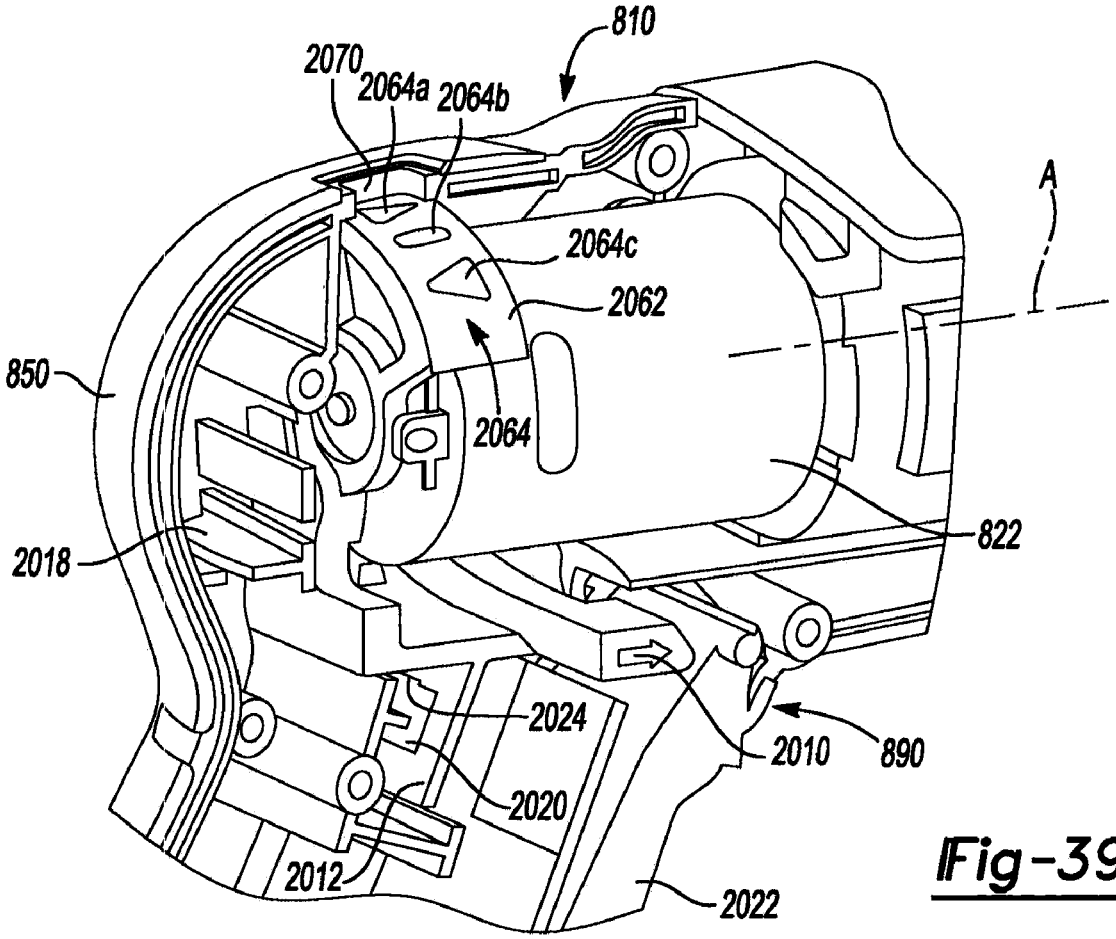
FIG. 39 is a perspective broken away view of a portion of the driving tool of FIG. 29.
Figure 40:
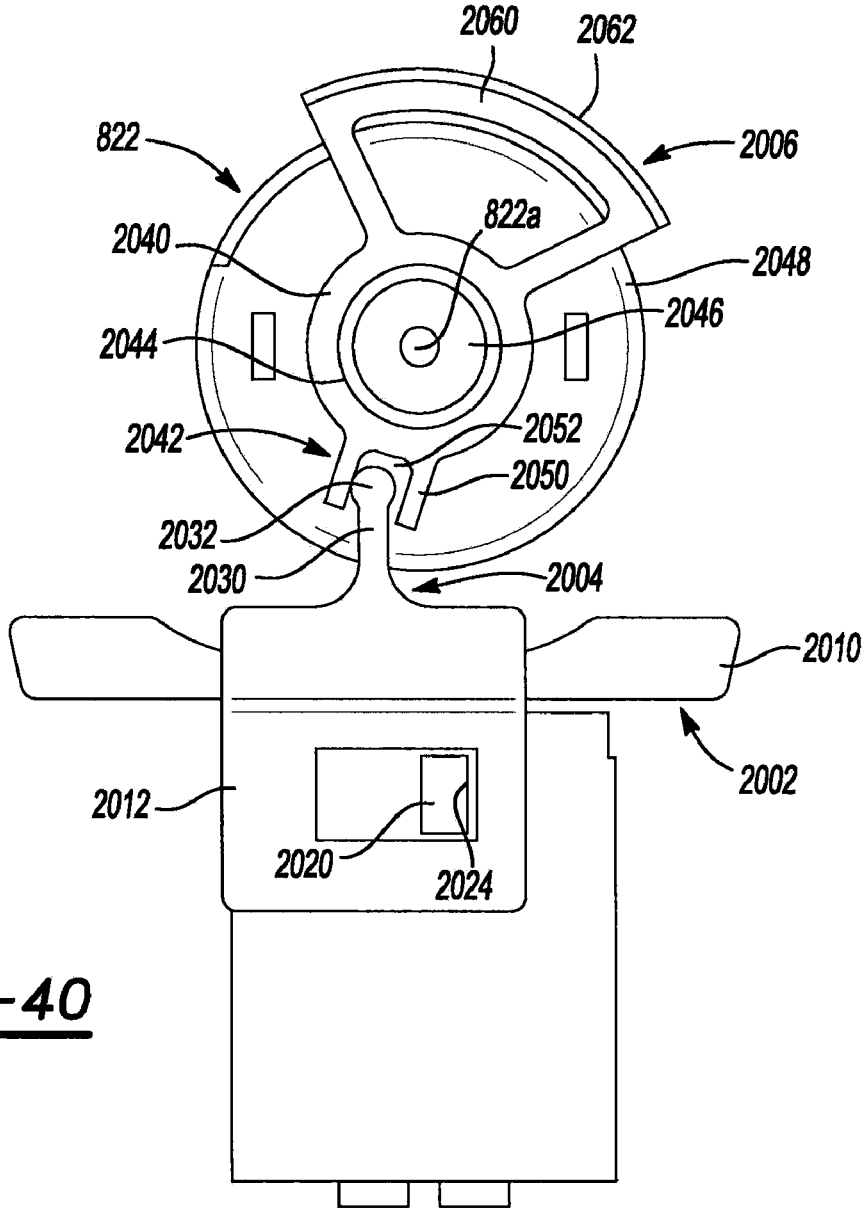
FIG. 40 is a rear elevation view of a portion of the driving tool of FIG. 29 illustrating the motor and the switch mechanism in more detail.
Figure 41:
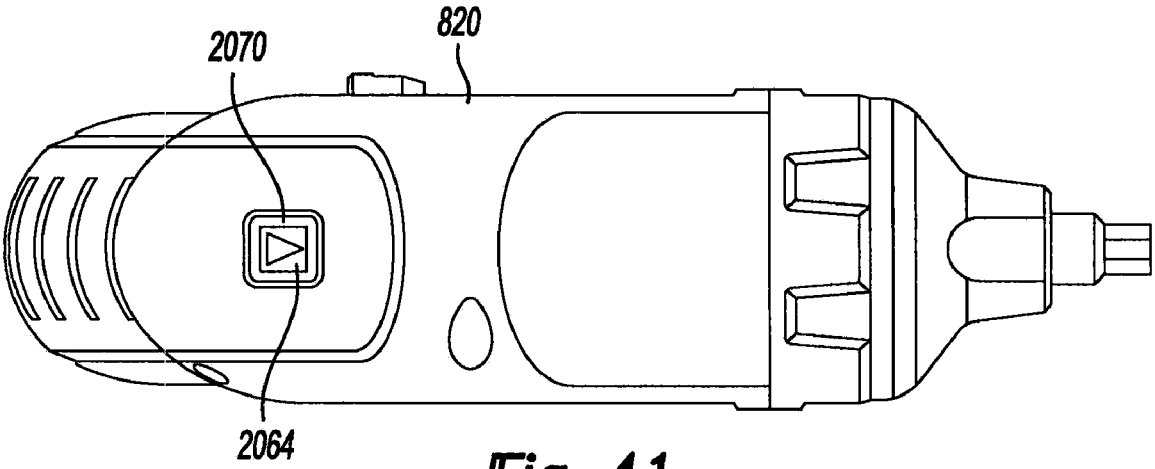
FIG. 41 is a top plan view of the driving tool of FIG. 29.

With reference to FIG. 39, the driving tool 810 can further include a reversing switch assembly 2000 that can be employed to control the direction in which the electric motor 822 rotates. With additional reference to FIG. 40, the reversing switch assembly 2000 can include a direction switch 2002, an actuator 2004 and an indicator 2006. The direction switch 2002 can comprise a switch member 2010, which is configured to receive an input from an operator of the driving tool 810, and a switch actuator 2012 that is coupled to the switch member 2010 for movement therewith. The housing shells 850 can include switch apertures 2014 (FIG. 29) on the opposite lateral sides of the driving tool 810 through which the switch member 2010 can extend. The housing shells 850 can also include internal structure, such as ribs 2018, to guide the direction switch 2002 as it is moved laterally between a first switch position and a second switch position. The switch actuator 2012 can be configured to interact with a reversing switch 2020 on the controller 2022 of the trigger switch 890. In the example provided, the switch actuator 2012 is a plate-like structure having a rectangular window 2024 into which the post-like reversing switch 2020 is received. It will be appreciated that the side of the window 2024 can be configured to move (i.e., slide or translate) the reversing switch 2020 into two positions (i.e., corresponding to forward and reverse rotation) or in three positions (i.e., corresponding to forward rotation, neutral and reverse rotation) as is employed in the present example.

The actuator 2004 can be coupled to the direction switch 2002 for movement therewith. In the particular example provided, the actuator 2004 includes a post-like structure 2030 that extends from the direction switch 2002 generally orthogonal to a longitudinal/rotational axis A of the motor 822 and the motion of the direction switch 2002. The post-like structure 2030 can terminate at its distal end in a spherically-shaped projection 2032.

The indicator 2006 can include a hub 2040 and a fork 2042. The hub 2040 can be an annular structure that can be journally mounted on the outer circumferential surface 2044 of a necked down portion 2046 of a motor case 2048 associated with the motor 822. It will be appreciated that the necked down portion 2046 of the motor case 2048 can house a bearing (not shown) that is configured to rotatably support an output shaft 822*a* of the motor 822 relative to the motor case 2048. The fork 2042 can include a pair of spaced apart wall members 2050 that define a space 2052 into which the post-like structure 2030 can be received. Contact between the post-like structure 2030 and the wall members 2050 as the direction switch 2002 is translated between the first, second and third switch positions (corresponding to forward rotation, neutral and reverse rotation, respectively) can cause the hub 2040 to rotate into first, second and third rotational positions, respectively.

The indicator 2006 can further include an indicator member 2060 that can be coupled to the hub 2040 for rotation therewith. The indicator member 2060 can be an arc-shaped segment and can include an indicator surface 2062 with directional indicia 2064 thereon that is indicative of each of the first, second and third switch positions. The directional indicia 2064 can be aligned to an aperture 2070 in the housing assembly 820 to indicate the setting of the direction switch 2002. For example, alignment of directional indicium 2064*a* to aperture 2070 can be indicative of the positioning of the direction switch 2002 in a first position, alignment of directional indicium 2064*b* to aperture 2070 can be indicative of the positioning of the direction switch 2002 in a second position, and alignment of directional indicium 2064*c* to aperture 2070 can be indicative of the positioning of the direction switch 2002 in a third position.

Preferably the directional indicia 2064 are spaced further apart from the rotational axis of the hub 2040 than the distance between the portion of the post-like structure 2030 that contacts the fork 2042 (i.e., the projection 2032 in the example provided) and the rotational axis of the hub 2040 so as to mechanically amplify the input made to the hub 2040. This permits, for example, the stroke of the direction switch 2002 to be maintained to a desired degree while permitting a fairly large arc on the indicator surface 2062 between directional indicia 2064.

While the indicator 2006 has been illustrated as being rotatably mounted on the motor 822, it will be appreciated that the indicator 2006 could also be rotatably mounted on the housing assembly 820. Moreover, while the fork 2042 and post-like structure 2030 have been associated with the indicator 2006 and the actuator 2004, respectively, those of skill in the art will appreciate that the fork 2042 could be associated with the actuator 2004 and that the post-like structure 2030 could be associated with the indicator 2006.

With reference to FIGS. 35 through 38, another driving tool having constructed in accordance with the teachings of the present disclosure. The driving tool is generally similar to the driving tool 810 that is illustrated in FIG. 29 and described above except for the fascia member 852', the detent spring 960' and the adjustment collar 962' of the clutch assembly 828'.

The fascia member 852' can include a spring mount 870' that can include an axial projection 1300 and an abutting wall 1302. The detent spring 960' can be mounted on the axial projection 1300 such that the engagement members 1012' are clipped to the opposite lateral sides of the axial projection 1300 and the detent spring 960' is abutted against the abutting wall 1302.

The adjustment collar 962' can include a plurality of circumferentially spaced apart detent recesses 1042' that are configured to be engaged by the projection 1010 of the detent spring 960' to maintain the adjustment collar 962' in a desired position. In this regard, radially projecting teeth 1310 are disposed between adjacent ones of the detent recesses 1042'. In the particular example provided, a radially projecting tooth 1310*a* that is disposed between the detent recess 1042*a'* associated with a highest (i.e., maximum torque) setting of the clutch assembly 828' and an adjunct detent recess 1042*b'* is relatively longer than the remaining radially projecting teeth 1310. Configuration in this manner requires additional torque to place the adjustment collar 962' into/move the adjustment collar 962' out of the position that is associated with the highest setting of the clutch assembly 828'.

While specific examples have been described in the specification and illustrated in the drawings, it will be understood by those of ordinary skill in the art that various changes may be made and equivalents may be substituted for elements thereof without departing from the scope of the present disclosure as defined in the claims. Furthermore, the mixing and matching of features, elements and/or functions between various examples is expressly contemplated herein so that one of ordinary skill in the art would appreciate from this disclosure that features, elements and/or functions of one example may be incorporated into another example as appropriate, unless described otherwise, above. Moreover, many modifications may be made to adapt a particular situation or material to the teachings of the present disclosure without departing from the essential scope thereof. Therefore, it is intended that the present disclosure not be limited to the particular examples illustrated by the drawings and described in the specification as the best mode presently contemplated for carrying out the teachings of the present disclosure, but that the scope of the present disclosure will include any embodiments falling within the foregoing description and the appended claims.

What is claimed is:

1. A tool assembly comprising:

a driving tool having a housing, a motor, an output member and a transmission for rotatably coupling the output member to the motor, the motor and the transmission being housed in the housing; and a holder assembly with a leg, a fastener guide and an adjustment mechanism, the leg being telescopically coupled to the housing, the fastener guide including a longitudinally extending groove, which is adapted to support a threaded fastener, the adjustment mechanism coupling the fastener guide to the leg on a side of the leg opposite the housing, the adjustment mechanism being configured to vary a distance between the groove and a rotational axis of the output member.

2. The tool assembly of claim 1 wherein the adjustment mechanism includes a spring that biases the fastener guide toward the rotational axis.

3. The tool assembly of claim 1 wherein the adjustment mechanism includes a first portion having a helical groove and a second portion with a feature that engages the helical groove and wherein relative rotation between the first and second portions in opposite rotational directions moves the fastener guide towards and away from the rotational axis.

4. The tool assembly of claim 3 wherein the adjustment mechanism includes a sleeve having a slot through which the feature is received and wherein interaction between the feature and the slot prevents the second portion from rotating relative to the sleeve.

5. The tool assembly of claim 1 wherein the fastener guide include a cam that intersects the groove.

6. The tool assembly of claim 1 wherein the fastener guide includes a magnet.

7. The tool assembly of claim 6 wherein the magnet is disposed in-line with the groove.

8. The tool assembly of claim 5 wherein the magnet forms at least a portion of the groove.

9. The tool assembly of claim 1 wherein one of the housing and the leg includes a plurality of first detent members and wherein the other one of the housing and the leg includes a second detent member that can releasably engage the first detent members to position the leg relative to the housing at a position selected from a plurality of predetermined positions.

10. The tool assembly of claim 1 wherein the driving tool further comprises a clutch having a clutch collar for adjustably setting the clutch to a clutch setting selected from a plurality of clutch settings.

11. The tool assembly of claim 10 wherein an inside surface of the clutch collar supports the leg of the holder assembly.

12. The tool assembly of claim 1 wherein the driving tool further comprises a light source.

13. The tool assembly of claim 12 wherein the leg is a light pipe for transmitting light produced by the light source from the light source to a point that is remote from the light source.

14. The tool assembly of claim 1 wherein the leg is movable into a retracted position in which the fastener guide is proximate the housing and disposed vertically in-line with the output member.

15. The tool assembly of claim 14 wherein the output member is received in the groove when the leg is positioned in the retracted position.

* * * * *